US007073355B2

(12) United States Patent
Traenkle et al.

(10) Patent No.: US 7,073,355 B2
(45) Date of Patent: Jul. 11, 2006

(54) KNITTING MACHINE WITH AT LEAST ONE STRIPING ATTACHMENT

(75) Inventors: Dietmar Traenkle, Balingen (DE); Axel Flad, Burladingen (DE); Dajana Tischler, Messstetten (DE)

(73) Assignee: SIPRA Patententwicklungs und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 11/167,867

(22) Filed: Jun. 27, 2005

(65) Prior Publication Data

US 2006/0010928 A1 Jan. 19, 2006

(30) Foreign Application Priority Data

Jun. 30, 2004 (DE) ..... 10 2004 032 270

(51) Int. Cl.
*D04B 15/60* (2006.01)

(52) U.S. Cl. ..... 66/138

(58) Field of Classification Search ..... 66/139, 66/140 R, 146, 134
See application file for complete search history.

(56) References Cited

U.S. PATENT DOCUMENTS

| | | | | |
|---|---|---|---|---|
| 3,613,404 A | | 10/1971 | Plath | |
| 3,788,104 A | | 1/1974 | Billi | |
| 4,385,507 A | | 5/1983 | Sawazaki | |
| 4,584,851 A | | 4/1986 | Plath | |
| 4,656,842 A | * | 4/1987 | Sawazaki et al. | 66/139 |
| 5,070,709 A | * | 12/1991 | Guell | 66/140 R |
| 5,826,446 A | * | 10/1998 | Plath et al. | 66/140 R |
| 6,000,245 A | * | 12/1999 | Plath et al. | 66/139 |
| 6,408,655 B1 | * | 6/2002 | Ossensi et al. | 66/140 R |
| 6,655,176 B1 | * | 12/2003 | Wang | 66/140 R |

FOREIGN PATENT DOCUMENTS

| | | |
|---|---|---|
| DE | 27 10 045 | 9/1977 |
| DE | 28 05 779 | 8/1978 |
| DE | 31 29 724 A1 | 4/1982 |
| DE | 33 11 361 A1 | 10/1984 |
| DE | 33 48 030 C2 | 10/1986 |
| DE | 195 11 949 A1 | 10/1996 |
| EP | 1 059 376 | 12/2000 |
| EP | 1 136 608 | 9/2001 |

* cited by examiner

*Primary Examiner*—Danny Worrell
(74) *Attorney, Agent, or Firm*—Michael J. Striker

(57) ABSTRACT

A knitting machine is described, which includes at least one carrier provided with knitting tools (2, 3), a cam mechanism with at least one knitting point (71) for moving selected knitting tools (2, 3) into a yarn pick-up position and a striping attachment for feeding selected yarns to the knitting tools (2, 3) brought into the yarn pick-up position. According to the invention, the striping attachment has at least one first and one second yarn changing device (73, 74) such that yarns (78, 79) fed optionally by the first or the second yarn changing device (73, 74) may be laid into the knitting tools (2, 3) brought into the yarn pick-up position at the knitting point (71) (FIG. 12).

14 Claims, 21 Drawing Sheets

KNITTING MACHINE WITH AT LEAST ONE STRIPING ATTACHMENT

FIELD OF THE INVENTION

This invention relates to a knitting machine comprising at least one carrier provided with movable knitting tools, a cam mechanism with at least one knitting point for moving selected knitting tools into a yarn pick-up position and at least one striping attachment assigned to the knitting point and having a yarn changing device for feeding selected yarns to the knitting tools brought into the yarn pick-up positions. The invention also relates to a striping attachment.

BACKGROUND OF THE INVENTION

In the majority of known knitting machines of this type, the yarn changing devices are provided with a particular number of, for instance four, yarn fingers, such that in each knitting system comprising a knitting point and a yarn changing device, optionally either one of four yarns may be laid into the knitting tools (e.g. DE 27 10 045 A1, DE 28 05 779 A1, DE 31 29 724 C2, DE 195 11 949 A1). From time to time, however, there is a trend towards fabrics with stripe patterns (sometimes also called hooped patterns), which may be made from more than the given number, i.e. for instance, from five or more yarns per system. It has therefore already been proposed that yarn changing devices should be provided with five or more selectable yarn fingers. A problem resulting therefrom, however, is that the yarn fingers and the associated parts have to be made substantially thinner than previously if the yarn changing devices are to have the same overall width as with just four yarn fingers. A consequence of this is increased wear and lower operational reliability. If, however, the yarn fingers and the associated parts are made with the usual width, the result is a correspondingly increased width of the knitting systems overall. This is undesirable since the number of knitting systems that may be accommodated on the periphery of a circular knitting machine is thereby reduced. This, in turn, requires not only a new design of the knitting machine compared with a knitting machine whose yarn changing devices are equipped for only four yarns, but leads also to a knitting machine of reduced performance. The latter is particularly undesirable if the striping function is not needed at times or to the full extent which, due to the constantly changing dictates of fashion, could well be required.

SUMMARY OF THE INVENTION

It is, therefore, an object of this invention to design the knitting machine above specified such that fabrics with stripe pattern may be manufactured from more yarns than is possible with a single yarn changing device.

A further object of this invention is to provide a knitting machine of the kind mentioned above in such a manner that fabrics with more striping yarns can be manufactured than is possible with a single yarn changing device without substantial change of the machine design and without a new design of the knitting machine is necessary, respectively.

Yet another object of this invention is to design the knitting machine and the yarn changing devices such that two or more yarn changing devices and an associated knitting point may be combined to a knitting system.

According to another object of this invention the arrangement should preferably also be such that the knitting machine may be operated at a relatively high output when not all of the yarn changing devices are in use.

A further object of this invention is to provide a striping attachement for the knitting machine of the kind specified above.

These and other objects are solved in accordance with this invention by means of a knitting machine of the kind mentioned above and being characterised in that the striping attachement has at least, respectively, one first and one second yarn changing device such that yarns fed from the first and the second yarn changing devices may optionally be laid into the knitting tools brought into the yarn pick-up position at the knitting point.

A striping attachement of the present invention is, therefore, characterised by at least two yarn changing devices which may be combined with a selected knitting point of the knitting machine to a knitting system.

The invention is based substantially on the concept of bringing together in a knitting machine with a plurality of yarn changing devices, two or more yarn changing devices to a common striping apparatus and of bringing such a striping apparatus together with an assigned knitting point to form a joint knitting system. Particularly advantageously, the arrangement is carried out such that for instance, as is known, a yarn changing device is provided at each of a plurality of knitting points and that, if required, at least one knitting point is made inactive in order to assign thereby two or more yarn changing devices to a neighbored knitting point. It is thereby possible, on the one hand, depending upon the requirements, to make stripe patterns with, for instance, four or more yarns. On the other hand, an existing knitting machine provided with yarn changing devices may be converted, as required, to have striping attachments having more yarns than corresponds to the number of yarns which can be fed by means of each single yarn changing device.

Further advantageous features of the invention are given in the dependant claims.

BRIEF DESCRIPTION OF THE DRAWINGS

The invention will now be described in greater detail, with the aid of an embodiment and referring to the accompanying drawings, in which.

DETAILED DESCRIPTION OF THE INVENTION

The invention will now be described in greater detail on the basis of what is regarded as the best embodiment, i.e. a circular knitting machine operating using the so-called relative movement technology.

Figure 1:
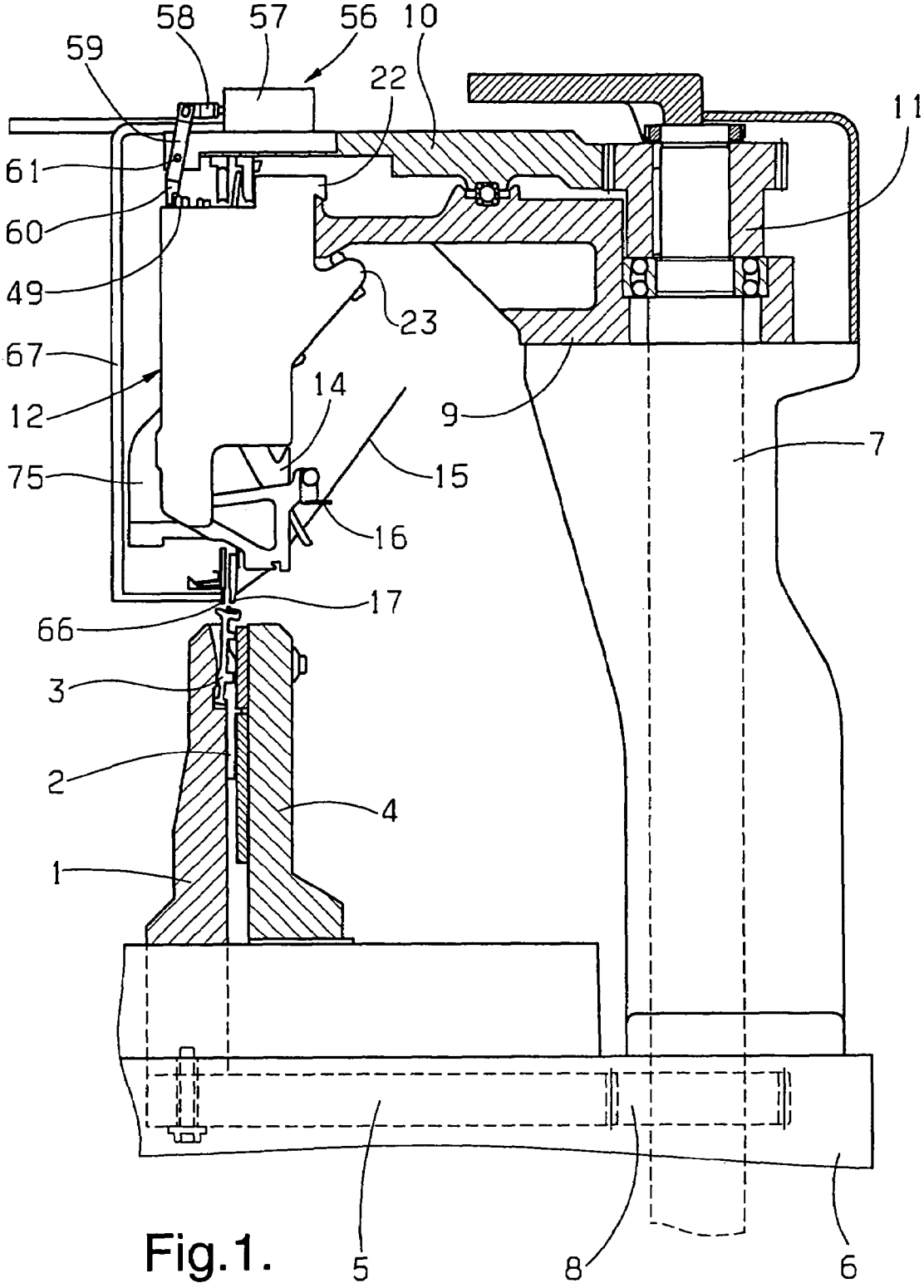
FIG. 1 shows a vertical section through a known circular knitting machine with a yarn changing device.

For this purpose, the circular knitting machine includes, as FIG. 1 shows, a carrier 1 in the form of a needle cylinder which is rotatably mounted about a vertical rotation axis and is provided with knitting tools in the form of latch needles 2 and sinkers 3, which are arranged displaceable both radially and axially up and down. The movements of the knitting tools 2, 3 are controlled in known manner with cams, which are attached on a cam box ring 4 which is mounted stationary in a machine chassis. Furthermore, the carrier 1 is supported on a carrier ring 5, which is rotatably mounted on a base plate 6 and may be rotated by means of a gear wheel 8 attached to a drive shaft 7.

Mounted locally fixed in a portion of the chassis above the carrier 1 is a ring-shaped holder 9 on which a support ring 10 coaxial with the carrier 1 is rotatably mounted by means of bearings, said support ring being able to be rotated in synchronisation with the carrier 1 by a gear wheel 11 also attached to the drive shaft 7.

On the holder 9, at least one, and preferably a plurality of yarn changing devices 12 are mounted locally fixed, having at least two and preferably four yarn fingers 14, from which, in each case, at least one yarn 15, which is pulled off a supply coil (not shown in detail) and is fed through a feed eye 16, may be laid into a yarn guide 17 in order that this yarn is presented to the hooks of the knitting tools 2.

Figure 2:
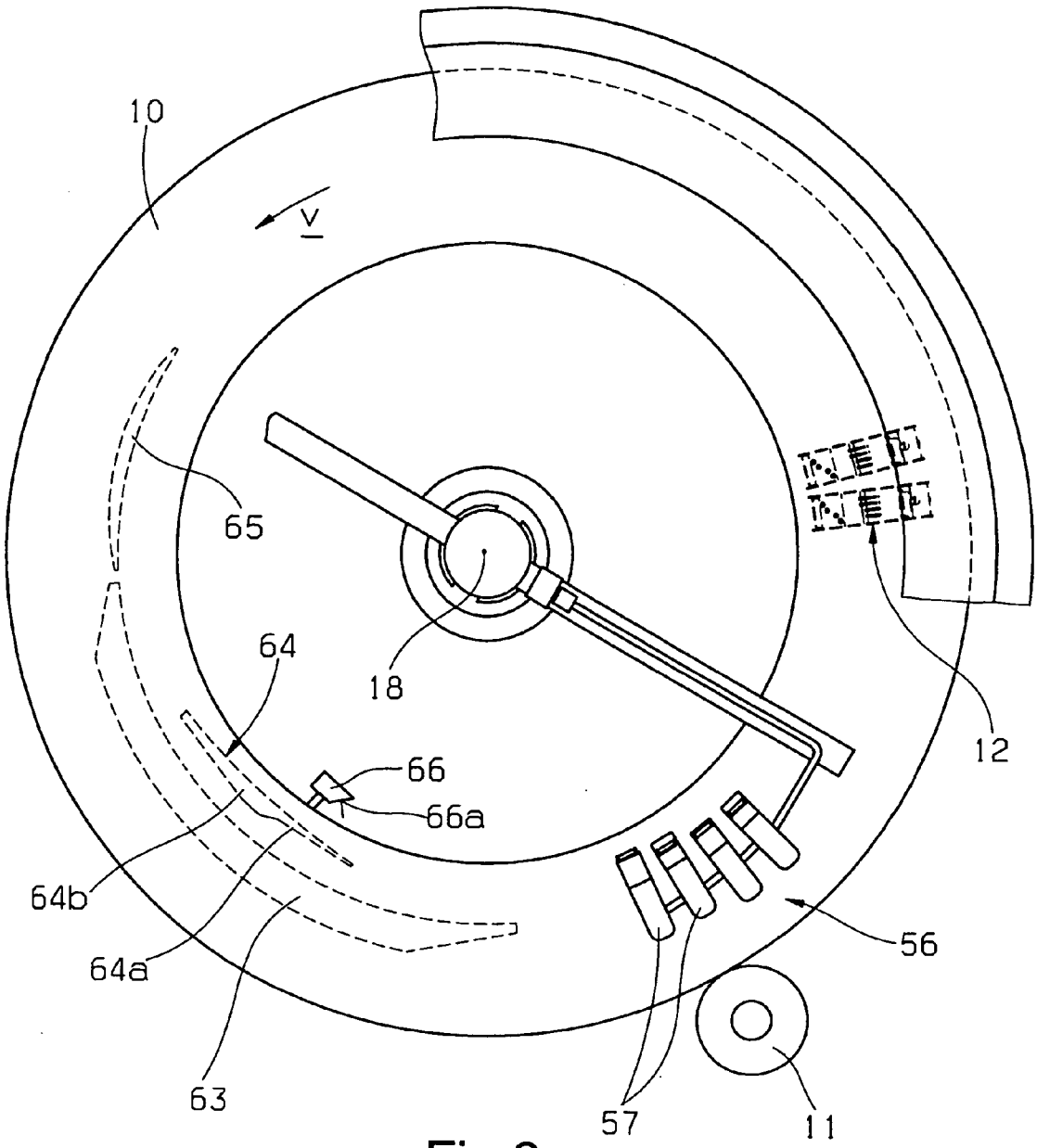
FIG. 2 shows a schematic plan view of the circular knitting machine of FIG. 1.

FIG. 2 shows schematically, above all, the support ring 10 and the gear wheel 11, and a rotation axis for the support ring 10 and the carrier 1 (not visible) is indicated with the reference number 18. Parts indicated dashed in FIG. 2 are arranged under the support ring 10 as in FIG. 1. For the sake of simplicity, only two yarn changing devices 12 are shown here, these being arranged circumferentially round the rotation axis 18 at a small separation. The yarn changing devices 12 each form in known manner together with an associated knitting point a knitting system. At each knitting point, the knitting tools 2, 3 may be moved into yarn pick-up positions in order to pick up the yarns 15. Naturally, fewer yarn changing devices 12 than knitting points may also be present.

Figure 3:
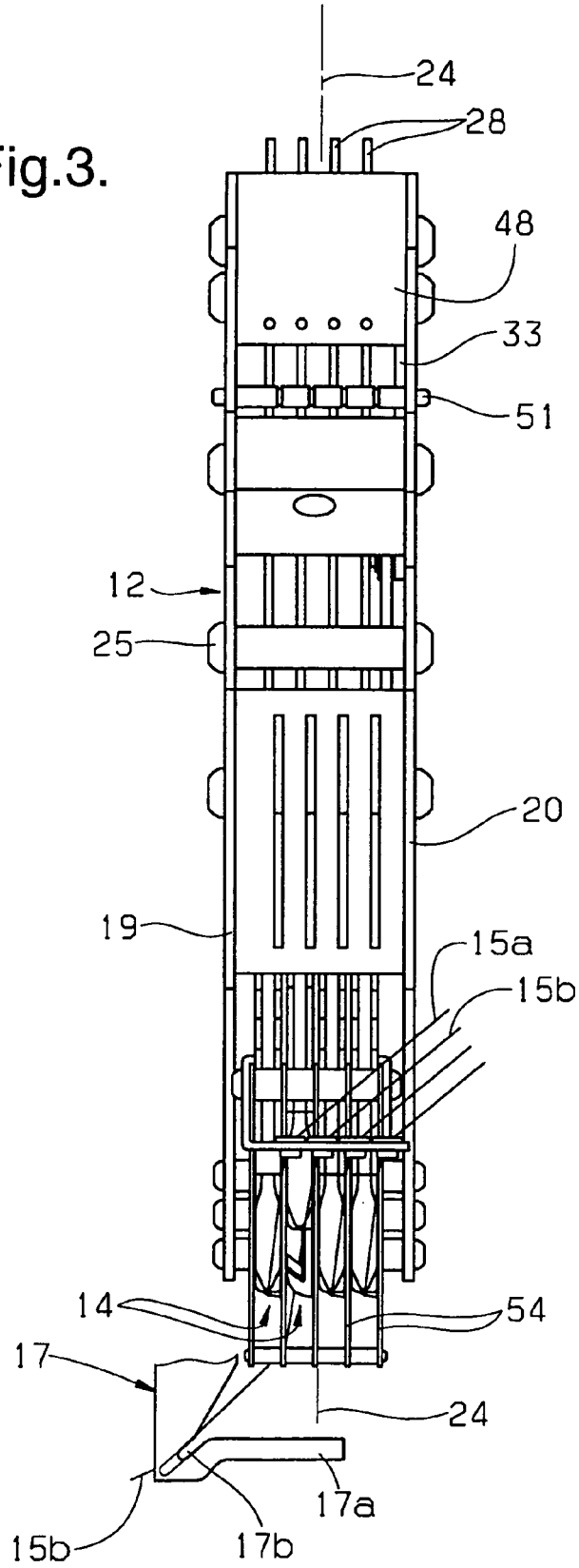
FIG. 3 shows the front view of a yarn changing device of the circular knitting machine of FIGS. 1 and 2.
Figure 4:
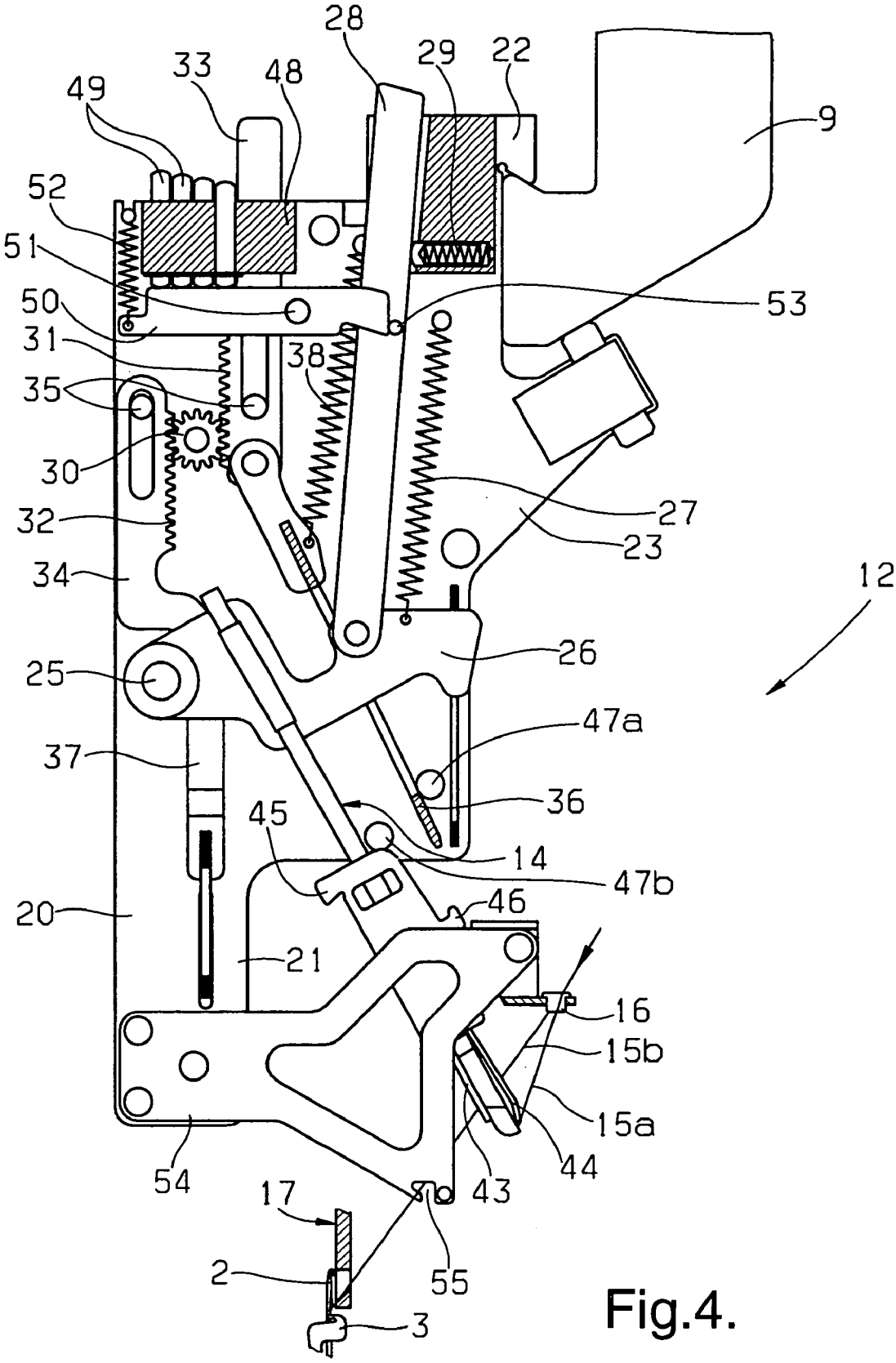
FIG. 4 shows a side view of the yarn changing device of FIG. 3.

According to FIGS. 3 and 4, each yarn changing device 12 contains an elongated, substantially cuboid-shaped housing comprising two parallel side plates 19 and 20, whereby the side plate 19 is omitted in FIG. 4, in order to clear the view into the interior of the housing. The side plates 19 and 20 have in a lower forward portion, a recess 21 and in an upper forward position, shoulders 22 and 23, which serve to attach the yarn changing device 12 on the holder 9. A longitudinal axis 24 (FIG. 3) of the housing is vertical, i.e. parallel to the displacement direction of the knitting tools 2 and preferably parallel to the rotation axis of the carrier 1.

A bolt 25 arranged between the side plates 19, 20 serves for pivotable mounting of plate-shaped single-armed pivot levers 26 of the yarn fingers 14. The pivot levers 26 are pretensioned by springs 27 into a basic position apparent in FIG. 4. Each pivot lever 26 is pivotably linked to an assigned selection lever 28, which is arranged substantially parallel to the longitudinal axis 24 and above the pivot lever 26. In a basic position and in particular in a working position still to be explained, the selection lever 28 extends with its upper end upwardly out of the housing of the yarn changing device 12. Each selection lever 28 is pretensioned by a spring 29 which tends to pivot it transversely to the longitudinal direction and, in relation to the circular knitting machine of FIGS. 1 and 2, radially inwardly.

Rotatably mounted on a further bolt is a gear wheel 30, which is in engagement with two parallel gear racks 31 and 32. In FIG. 4 the gear rack 31 is attached on the left-hand edge of a pusher 33 designed as a control organ, and the gear rack 32 is attached on the right edge of a pusher 34. The upper end of the pusher 33 projects upwardly in a basic position out of the housing of the yarn changing device 12. Both pushers 33, 34 are movably guided with slotted holes on bolts 35. The one end of a closer 36 is linked in articulating manner to the lower end of the pusher 33, whilst the pusher 34 is, at its lower end, preferably firmly linked to an opener 37. The closer 36 is normally pretensioned radially outwardly by a spring 38 against a stop 47*a*, although it may be pivoted clockwise and against the force of the spring 38 radially inwardly until it lies against a stop 47*b*. In a basic position, the spring 38 also holds the pusher 33 in its highest position and therefore the pusher 34 in its lowest position in FIG. 4. The members 30 to 35 comprise a reversing (deflection) gearbox for common actuation of the closer 36 and the opener 37.

The closer 36 suitably comprises a plate extending over the entire width of the housing, said plate being provided with an opening through which the pivot levers 26 project. Similarly, the opener 37 suitably comprises an angle profile, one limb of which is designed as a bar extending transversely and over all the pivot levers 26.

Figure 5:
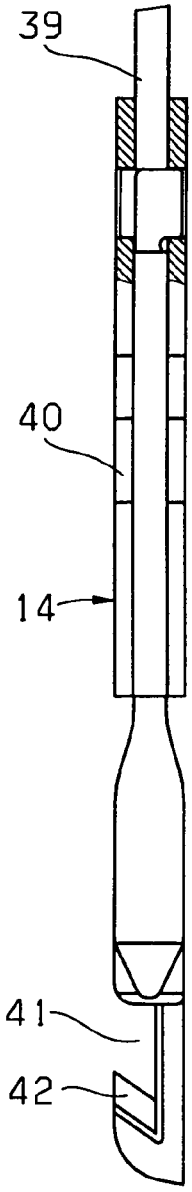
FIGS. 5 to 9 show a yarn finger of the yarn changing device of FIGS. 3 and 4 with a clamping means or trapper open and closed in an enlarged front view, side view and rear view and in a cross-sectional view.
Figure 6:
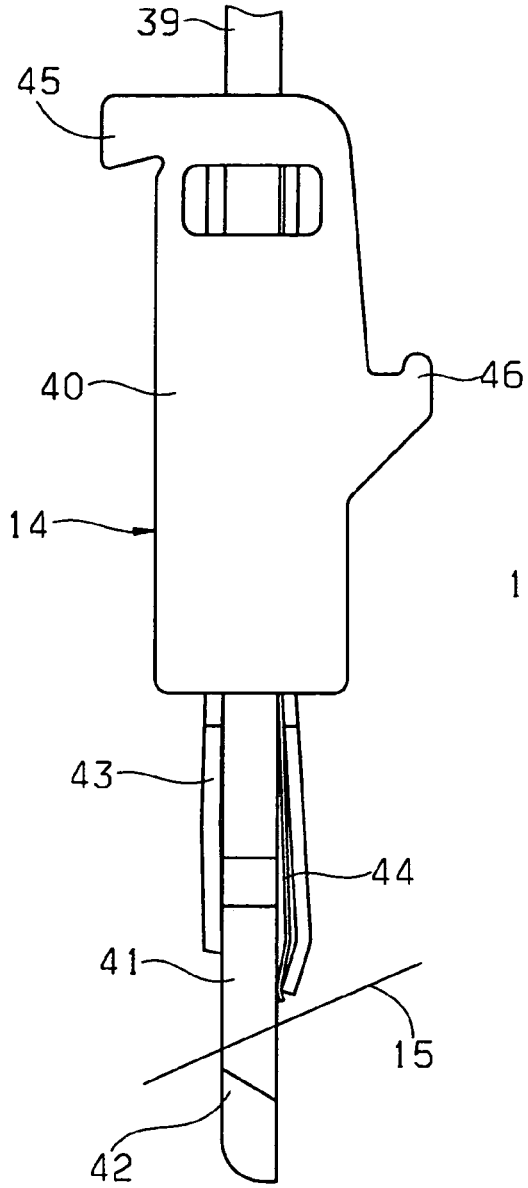
Figure 7:
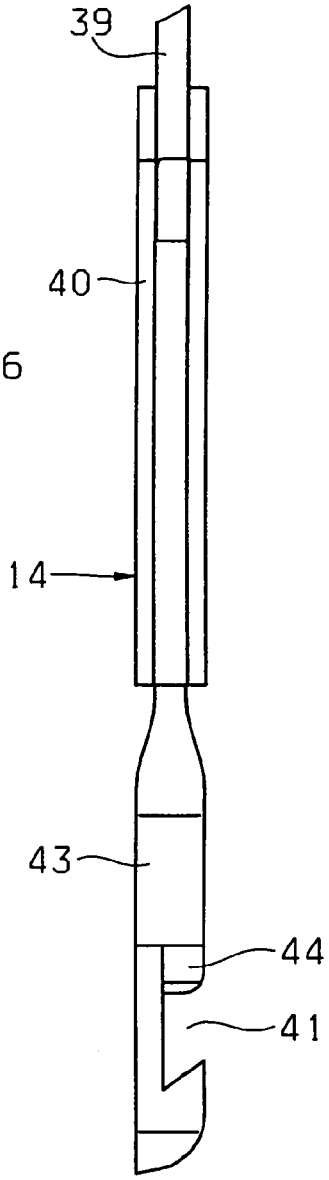
Figure 8:
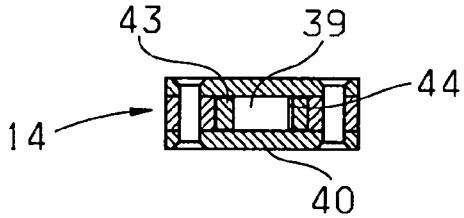
Figure 9:
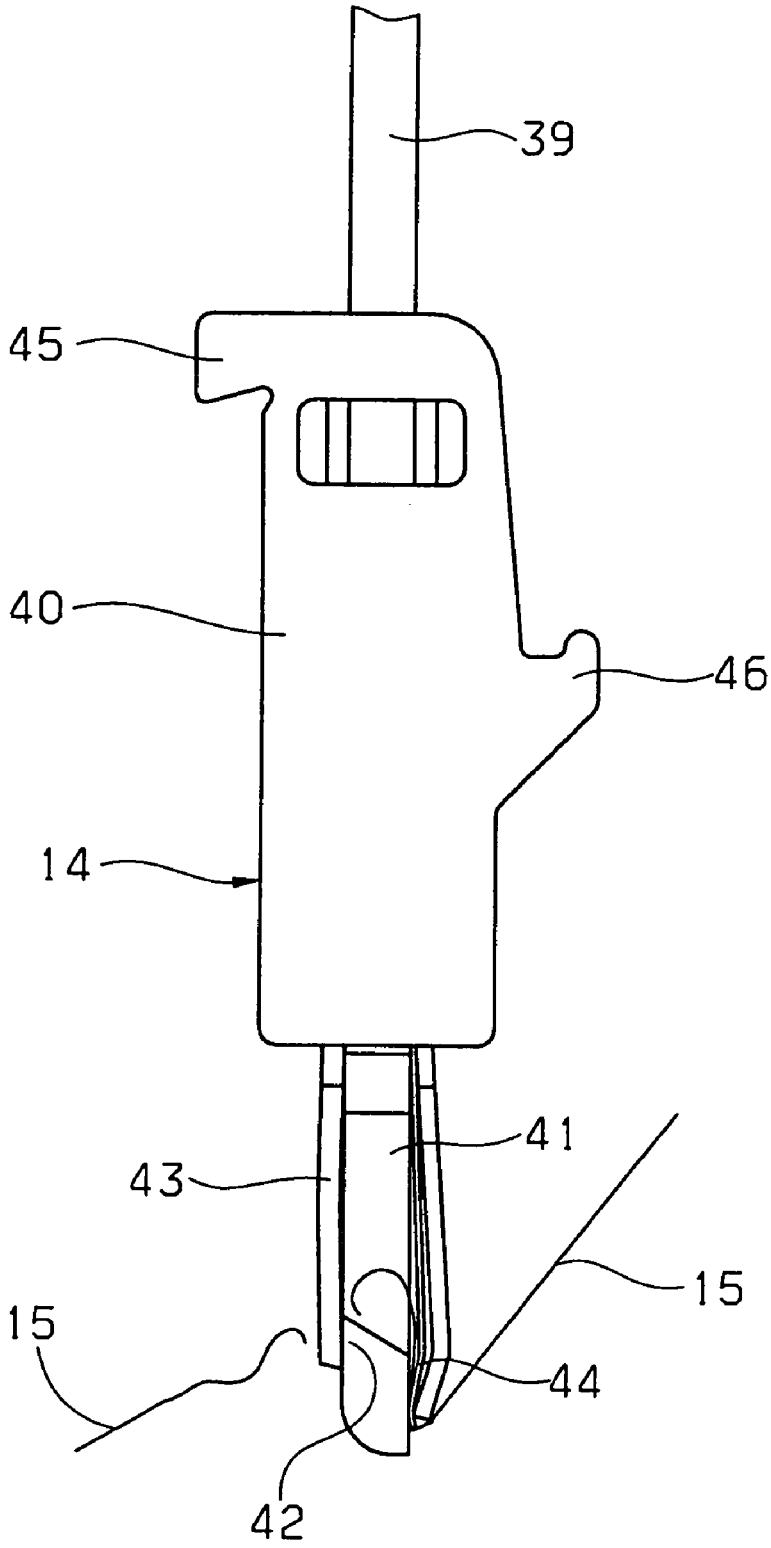

According to FIGS. 5 to 9, each yarn finger 14 contains a linear, rod-shaped finger body 39, which is attached with its end that is uppermost in FIGS. 5 to 9 to the associated pivot lever 26. A guide body 40 is displaceably guided on each finger body 39. At the lower end, the finger body 39 has a U-shaped recess 41 through which the thread 15 (FIGS. 1, 6 and 9) may run and whose lower border is formed as a cutting edge 42 (FIG. 5). The guide body 40 bears a cutting element 43 on one side of the finger body 39 which interacts with the cutting edge 42 and, on the opposing side, a clamping element 44 elastically pressing against the finger body 39. Furthermore, the guide body 40 has, on the side assigned to the cutting element 43, a projection 45 interacting with the opener 37 (FIG. 4) and on its side assigned to the clamping element 44, a projection 46 interacting with the closer 36.

It is also to be understood that the yarn changing device 12 according to FIGS. 3 to 9 has as many yarn fingers 14 and selection levers 28 as the number of different yarns 15 that are required to be supplied. In the embodiment shown, four yarn fingers 14 and four selection levers 28 are provided.

Mounted at the upper end of the housing of the yarn changing device is a guide body 48 (FIG. 4), in which four control pins 49 are guided parallel to the longitudinal axis 24 with a sliding fit. Furthermore, the guide body 48 serves as a sliding bearing of the upper portion of the pusher 33. The control pins 49 are each supported on one of four assigned preselection levers 50, which are pivotably borne on a further bolt 51 and in FIG. 4 extend substantially horizontally, i.e. perpendicular to the selection levers 28. By means of springs 52 engaging on their rearward ends, the selection levers 50 are pretensioned in a basic position in the clockwise direction and in contact with the lower ends of associated ones of the control pins 49 projecting out of the guide body 48. The preselection levers 50 lie in their basic position with their forward end faces against detent pins 53, which are fixed to the associated selection levers 28 and project laterally from these.

Arranged in the lower portion of the housing according to FIGS. 3 and 4, between and parallel to the side plates 19 and 20 is a number of guide plates 54 which partially cover the recesses 21. These guide plates 54 serve for lateral, largely rattle-free guidance of the yarn fingers 14 during their pivoting movements and, if required, may additionally be provided with lower recesses 55 into which the yarns 15 currently being processed by the circular knitting machine are laid.

As FIGS. 1 and 2, in particular, show, mounted on the rotatable support ring 10 is a selection apparatus 56, which has a number of control magnets 57 corresponding to the number of yarn fingers 14 and control pins 49, said control magnets 57 being arranged according to the control pins 49 offset in the radial direction. The control magnets 57 are designed, for instance, as solenoids and are each provided with a push rod 58 movable back and forth horizontally and radially, said push rod 58 being linked in articulating manner to a lever 59, which extends through a recess in a region arranged beneath the support ring 10, and bears a control cam 60 there and is pivotably borne in a central portion by means of a bolt 61 attached to the support ring 10. The control cam 60 is thus arranged in the radial direction, for instance, with the push rod 58 extended, above and in the range of action of an associated control pin 49 and, with the push rod 58 withdrawn, outside the range of action of the associated control pin 49. As a result, on rotation of the support ring 10 in the direction of an arrow v (FIG. 2) carried out together with the carrier 1, it is always only those control cams 60 that have been selected by corresponding control of the control magnets 57 which come into the range of action of associated control pins 49.

Furthermore, FIG. 2 in particular shows three switching cams 63, 64 and 65, which are mounted on the underside of the support ring 10. The front end of the switching cam 63 leading in the rotation direction (arrow v) but following behind the selection apparatus 56 is assigned to the selection levers 28 (FIG. 4), the switching cam 64 beginning thereafter is assigned to the pusher 33 and the last switching cam 65 is also assigned to the selection levers 28. Finally, in FIG. 2, an insertion or laying-in means 66 attached to the support ring 10 is shown schematically, said laying-in means 66 serving in known manner to catch the yarn 15 laid in by a selected yarn finger 14 above a web 17*a* of the yarn guide 17 (FIG. 3) and to place it reliably in a slit 17*b* formed behind the web 17*a* of the yarn guide 17. As FIG. 1 in particular shows, the laying-in means 66 is attached to an arm 67 linked to the support ring 10 and held closely above and behind the hooks of the knitting tools 2.

The mode of action of the circular knitting machine described will now be described in greater detail based upon FIGS. 1 to 11, whereby members additionally identified with the letter "a" are assigned to a newly laid-in yarn 15*a* and those additionally identified with the letter "b" are assigned to an old yarn 15*b* that is still being processed.

In FIGS. 3 and 4, it is assumed that of the total of four yarns, the yarn 15*b* is being knitted and laid into the hooks of the knitting tools 2. Therefore, the yarn 15*b* lies in FIG. 4 (see also FIG. 6) in the open recess 41 of an invisible yarn finger 14 and in the recess 55 of the associated guide plate 54. All the other yarns assume the same clamped position as the yarn 15*a* in FIG. 4 (see also FIG. 9).

Figure 10:
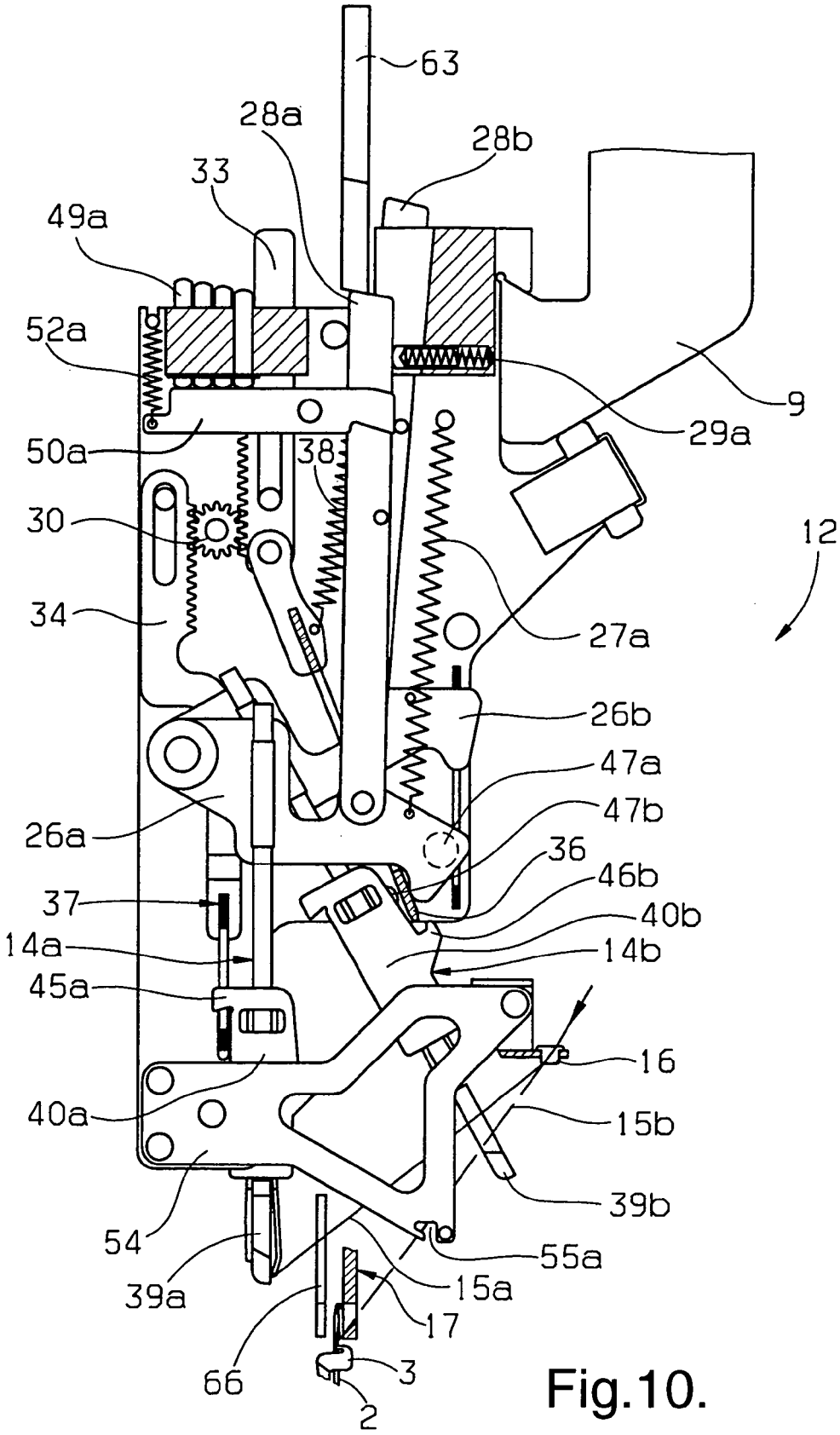
FIGS. 10 and 11 each show a side view of the yarn changing device of FIG. 4, but in other operating positions.

If a yarn change is to take place to, for instance, the yarn 15*a*, on rotation of the support ring 10, initially the associated control magnet 57 (FIG. 1) is activated and thereby the control cam 60 coupled to it is positioned above the associated control pin 49. On further rotation of the support ring 10, this has the consequence that the control pin 49 is gradually pushed downwards by the control cam 60 and the associated preselection lever 50 is pivoted in the anticlockwise direction and is lifted off with its end face of the detent pin 53 of the associated selection lever 28. By this means, the spring 29 now pivots the selection lever 28 anticlockwise into a working position, such that its upper end is arranged in the region of the switching cam 63 (FIGS. 2 and 10). Selection of the yarn 23 is thereby prepared.

FIG. 10 also shows that on further rotation of the support ring 10, the switching cam 63 acts with a downwardly increasing section on the selection lever 28*a* situated in the working position and pushes it downwards. By this means, the actual yarn change is initiated in that, on the one hand, the associated yarn finger 14*a* is pivoted clockwise (FIG. 4) into the working position by means of the pivot lever 26*a* and, on the other hand, the preselection lever 50*a* and with it the control pin 49*a* is guided back into the basic position by the spring 52*a* after reaching the end of the control cam 60. Pivoting of the yarn finger 14*a* has the consequence that the lower end of the associated finger body 39*a* is pivoted from a basic position situated radially outwardly in relation to the knitting tools 2 into a working position radially behind the back and directly above the hooks of the knitting tools 2. Therefore in FIG. 10, the finger body 39*b* guiding the old yarn 15*b* is now also visible. Through pivoting of the pivot lever 26*a*, the closer 36 is simultaneously lifted from the stop 47*a* and placed against the stop 47*b*. In this position, the lower free end of the closer 36 lies directly opposite the projection 46*b* of the guide body 40*b*. Furthermore, the yarn finger 14*a* is substantially vertical and arranged such that the opener 37 is arranged directly below its projection 45*a*. The sweeper-in 66 is already arranged directly before the yarn 15*a*.

On further rotation of the support ring 10, the sweeper-in 66 grasps the newly laid in yarn 15*a* held by the thread finger

14*a* and presses it with a downwardly sloping cam 66*a* deeper into the V-shaped slit 17*b* of the yarn guide 17 (FIG. 3), such that it is grasped, like the yarn 15*b*, by the hooks of the lifted knitting tools 2. By this means, both yarns 15*a* and 15*b* are simultaneously knitted in the region of a changing point.

On further rotation of the support ring 10, the switching cam 64 gradually comes into the region of the upper end of the pusher 33 (FIG. 11), such that said pusher 33 together with the closer 36 is pressed downwardly by a downwardly sloping section of the switching cam 64 and the pusher 34 is simultaneously pulled upwardly with the opener 37. By this means, on the one hand, the old yarn 15*b* is cut and clamped (see also FIG. 9). On the other hand, the clamped end of the new yarn 15*a* is released by the opener 37. The yarn change is thereby completed and now only the new yarn 15*a* is knitted. By suitable dimensioning of the separation of the closer 36 or of the opener 37 from the associated projections 46*b* or 45*a*, the precise time points may be set at which the respective yarn is to be cut, clamped or released.

On further rotation of the support ring 10, according to FIG. 2, it is the end of the switching cam 64 that is reached next, whereby under the action of the spring 38, the pushers 33 and 34 are moved back into their basic position according to FIG. 4 and simultaneously, the closer 36 is pivoted back from the stop 47*b* to the stop 47*a*. Thereafter, the end of the switching cam 63 (FIG. 2) is also reached, such that under the action of the spring 27*a*, the pivot lever 26*a* and the selection lever 28*a* are pivoted back into the basic position according to FIG. 4.

Finally, the switching cam 65 (FIG. 2) comes into the region of the upper end of the selection lever 28*a* and pivots it (which is not shown) in the transverse direction and against the force of the spring 29*a* into the basic position according to FIG. 4 again, whereby its detent pin 53 latches in behind the end surface of the associated preselection lever 50, such that the starting condition of all the parts is restored.

Circular knitting machines and yarn changing devices of the type described based on FIGS. 1 to 11 and their functional method are known to persons skilled in the art, in particular from the documents DE 33 11 361 C2, DE 33 48 030 C2 and DE 195 11 949 A1 which, in order to avoid further description of details are hereby made by reference to them to be part of the subject matter of the present disclosure.

Figure 12:
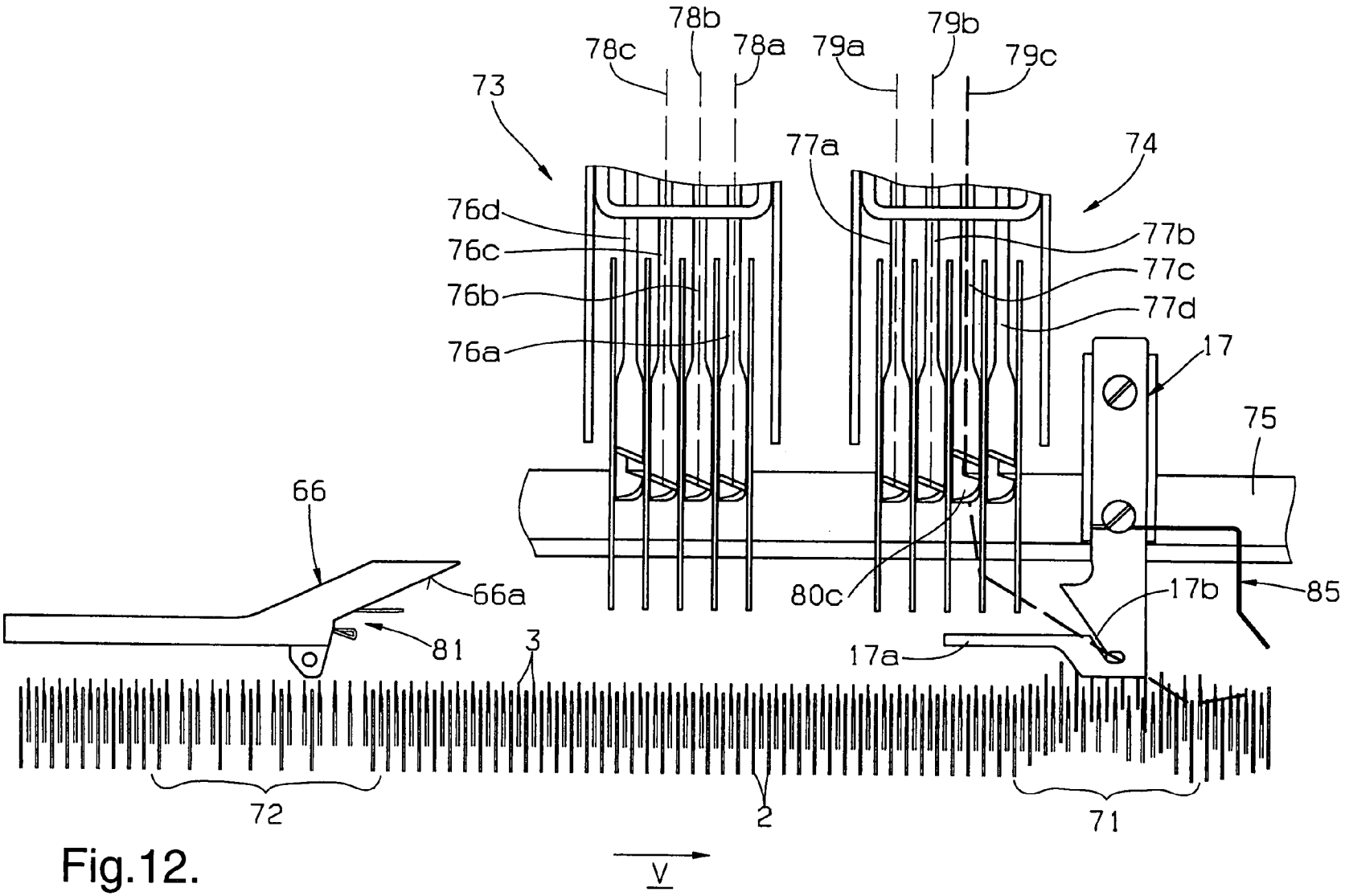
FIG. 12 shows a front view from radially outside, of parts of the circular knitting machine according to FIG. 1, but with a striping attachment according to the invention comprising two yarn changing devices of FIGS. 3 to 11 at the start of a yarn change.

Starting from the circular knitting machine described, according to the invention, it is proposed that at least two yarn changing devices be brought together in a striping attachment, as will now be described in greater detail with the aid of FIGS. 12 to 27. FIG. 12 shows, in a schematic unwrapping of the outer jacket of the needle cylinder in a circular knitting machine, a plurality of knitting tools 2 and 3 in the form, for instance, of latch needles and, arranged between them, sinkers functioning according to the relative movement technique. Furthermore, a knitting point 71 is indicated where the knitting tools 2 and 3 are moved with needle cams (not shown), initially into a position intended for yarn pick-up. For this purpose, the knitting tools 2 are lifted in known manner and the knitting tools 3 are pivoted radially inwardly, whereupon, for stitch formation, the knitting tools 2 and 3 are given a contrary movement in the axial direction, as is usual with relative movement technology.

The reference number 72 identifies a changing point, within which at least some knitting tools 2 are omitted and which serves in performing a yarn change, as will be made clear in the description below. Furthermore, FIG. 12 shows two yarn changing devices 73, 74 of the type described, lying mutually adjacent in a knitting direction, whereby the knitting direction indicated with the arrow v is understood here to be the direction in which the carrier or the needle cylinder 1 is moved during the knitting process. The yarn changing device 73 first reached by the changing point 72 in the knitting direction will be referred to below as the first yarn changing device, whilst the other changing device 74 will be referred to as the second yarn changing device. According to the invention, the arrangement is carried out such that the knitting tools 2, 3 brought into the yarn pick-up position at the knitting point 71 may optionally process yarns from the first and/or the second yarn changing device 73, 74, such that the two yarn changing devices 73, 74 are components of a same striping attachment assigned to the knitting point 71, and the striping attachment together with the knitting point 71 defines a knitting system of the circular knitting machine. In contrast to the otherwise usual art, there is no active knitting point present at the first yarn changing device 73.

FIG. 12 also shows a mounting ring 75 which is also visible in FIG. 1 and is fixed to the holder 9, and the yarn guide 17 attached to this in the region of the knitting point 71. The second yarn changing device 74 is arranged directly before the yarn guide 17, i.e. substantially at the knitting point 71, whilst the first yarn changing device 73 is arranged before the knitting point 71 and advantageously also before the second changing device 74 in the knitting direction.

The yarn changing devices 73, 74 are only roughly schematically indicated in FIGS. 12 to 27. They are designed similarly to the yarn changing devices 12 according to FIGS. 1 to 11 and are therefore each provided, in particular, with four yarn fingers 76*a* to 76*d* and 77*a* to 77*d*, corresponding to the yarn fingers 14. In each case, one yarn finger, e.g. 76*d* and 77*d* is unused, i.e. without a yarn, whilst the other yarn fingers each serve to feed in one yarn 78*a* to 78*c* and 79*a* to 79*c*. The purpose of the unused yarn fingers 76*d*, 77*d* is explained below.

Finally, FIG. 12 shows a position of the circular knitting machine shortly before a possible yarn change. This is thereby recognisable that the changing point 72 is situated here shortly before the first yarn changing device 73. At the time point shown, the yarn finger 77*c* guides its yarn 79*c* (shown bold) to the knitting tools 2, 3, for which reason its schematically indicated clamping element 80*c*, designed according to FIGS. 5 to 9, is open, whilst all the other yarns 78, 79 are clamped. The laying-in means 66 is also visible (see also FIG. 2) in the region of the changing point 72.

Figure 13:
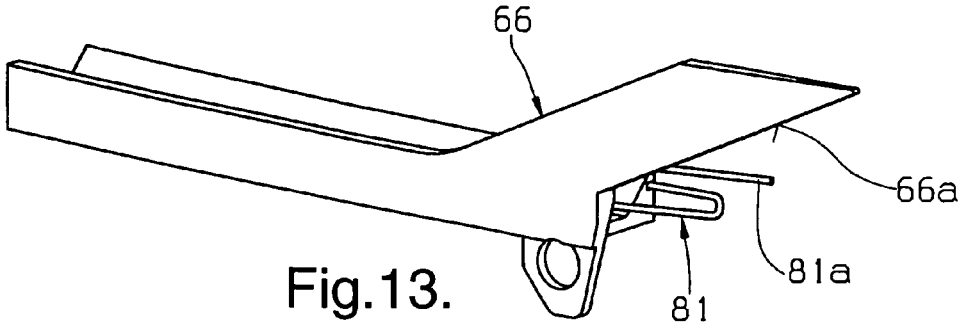
FIGS. 13 to 15 show an entrainment or engaging member of the striping attachment of FIG. 12 in a perspective view, respectively, from the front, from behind and in plan view.
Figure 14:
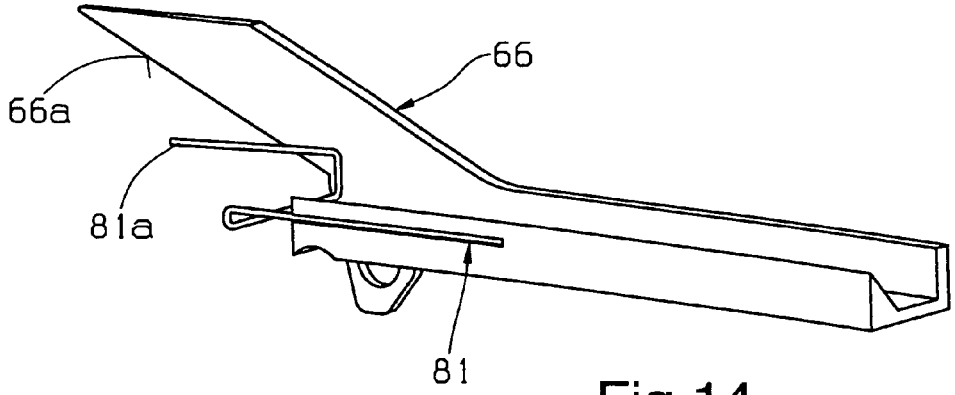
Figure 15:
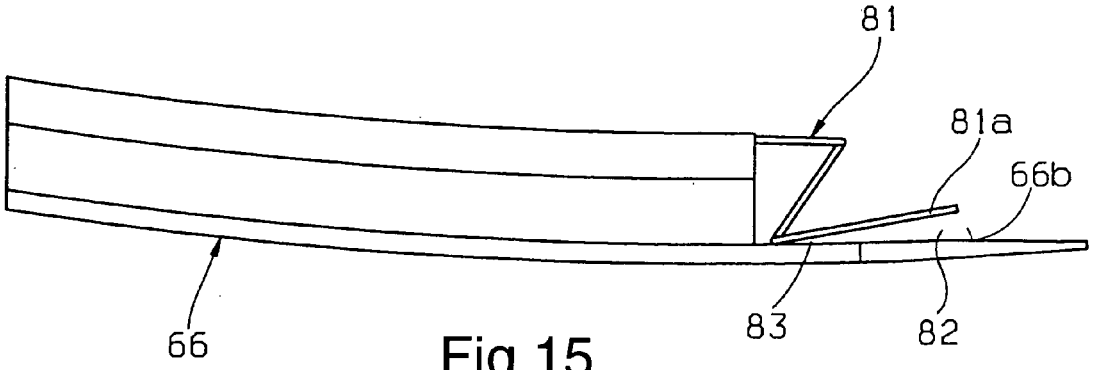

The laying-in means 66 arranged according to FIG. 1 in the backs of the knitting tools or knitting needles 2 is provided with an engaging or entrainment member 81 according to FIGS. 13 to 15 which serves to transport yarns 78 presented by the first yarn changing device 73 as far as the yarn guide 17. In the embodiment, the engaging member 81 is designed as an independently acting trapper, which is made from multiply-bent spring wire or spring band. As FIG. 1 shows, the laying-in means 66 is arranged within a circle formed by the knitting tools 2, and the engaging member 81 is situated on the side of the laying-in means 66 facing away from the backs of the knitting tools 2. The engaging member 81 has in particular a free end (FIG. 15) comprising a clamping organ 81*a* which, together with an internally situated wall 66 of the laying-in means 66, forms a V-shaped feeding-in gap 82 and with a rearward section, forming a clamping gap 83, lies in springing manner against the wall 66*b* of the laying-in means 66. Otherwise, the laying-in means 66, and with it the engaging member 81, moves in a space between the knitting tools 2, 3 and the yarn changing devices 73 and 74.

Figure 16:
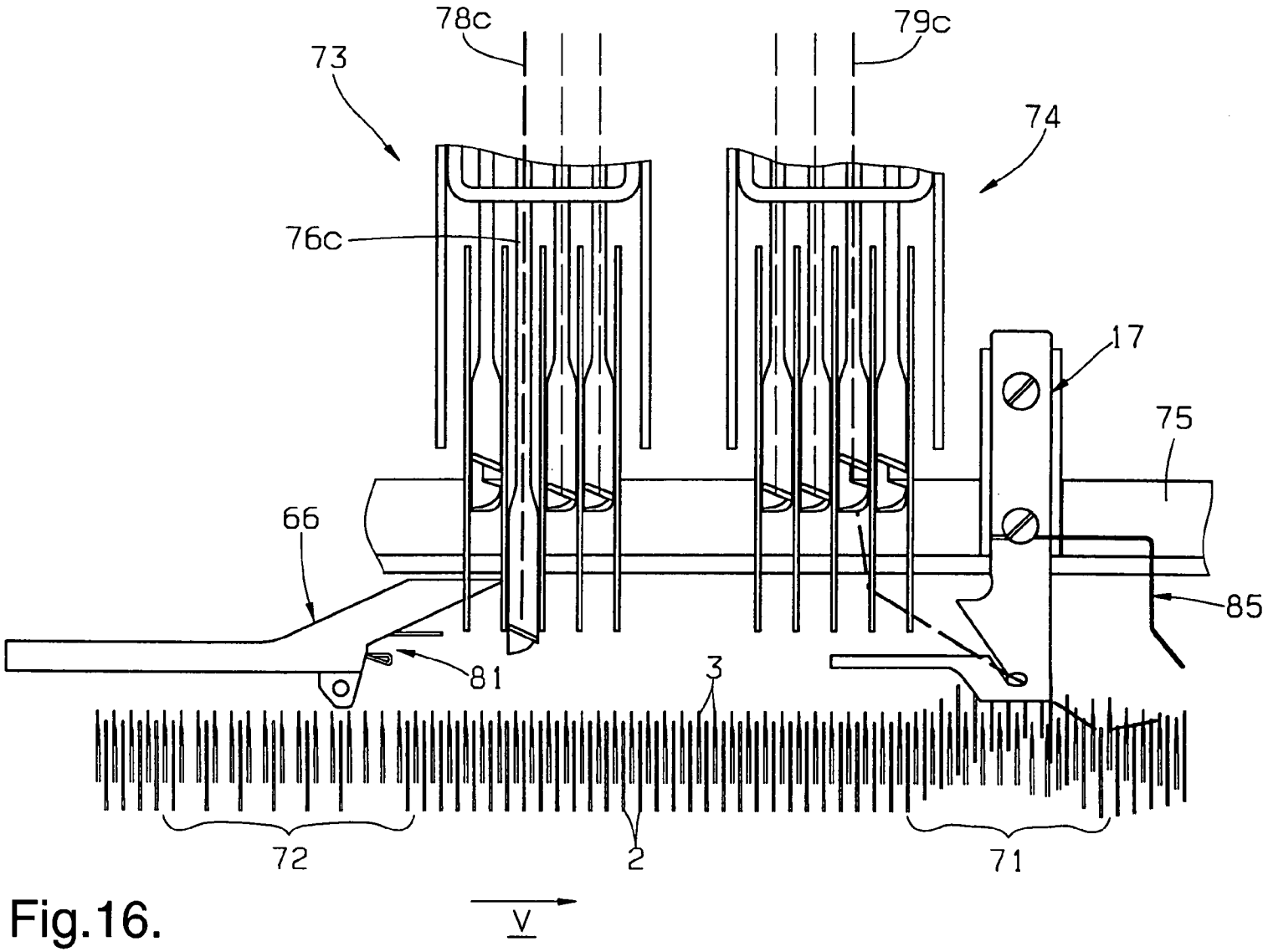
FIG. 16 shows the striping attachment according to the invention in a view according to FIG. 12, but in another operating position.
Figure 17:
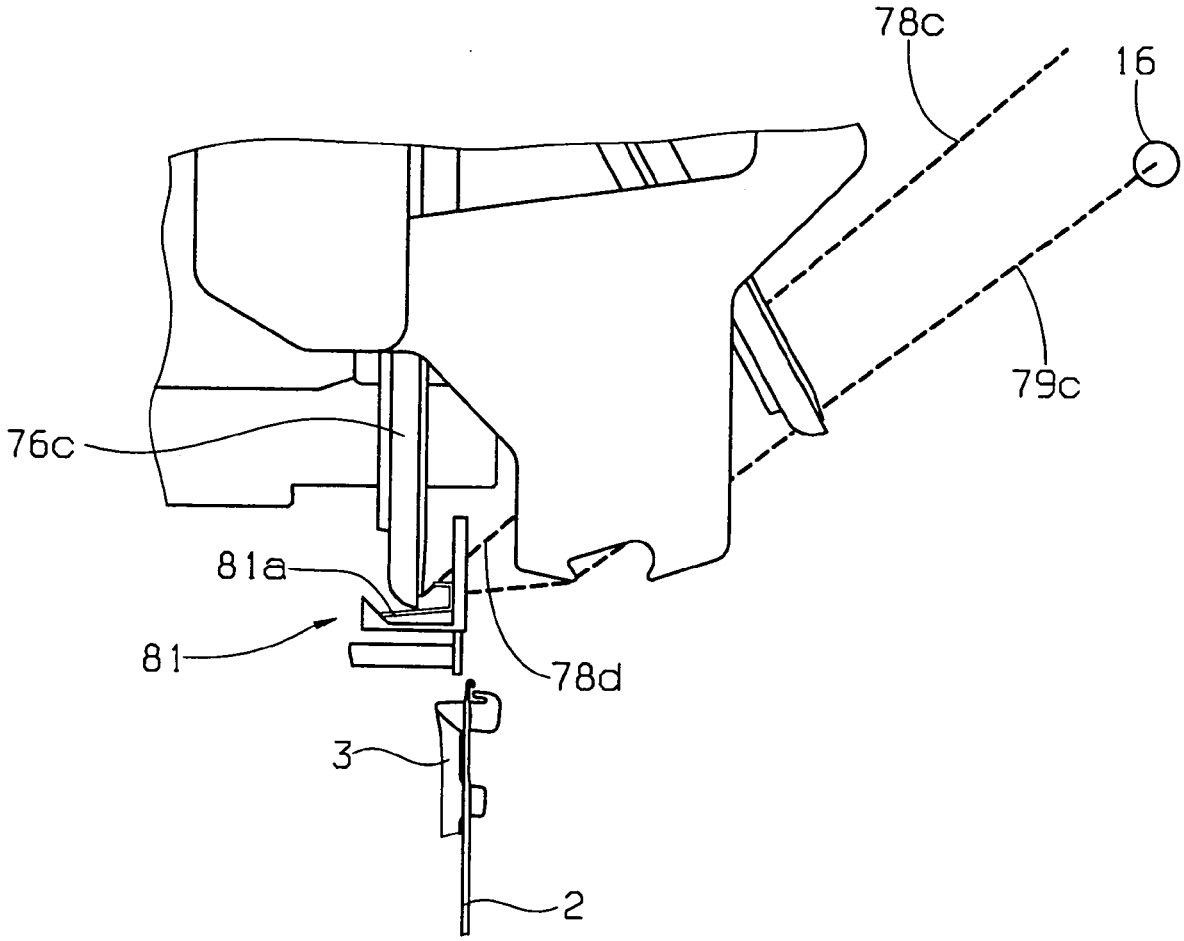
FIG. 17 shows a view from the left hand side of the striping attachment of FIG. 16.

For the change-over, described below by way of example, from the yarn 79*c* from the second yarn changing device 74 to the yarn 78*c* (also shown bold) from the first yarn changing device 73 (FIG. 16), the yarn finger 76*c* is initially pivoted into the working position shown in FIGS. 10 and 17 in that the associated control magnet 57 of the selection apparatus 56 (FIG. 1) is actuated at the right time. In order to avoid lack of clarity, in FIG. 17 the yarn guide 17 is omitted and the old yarn 79*c* still processed into stitches is shown as far as its feed eye 16. Due to the pivoting of the yarn finger 76*c*, the still clamped yarn 78*c* now lies with a section 78*d* (FIG. 17) extending between its feed eye and the yarn finger 76*c* radially to the needle cylinder axis, i.e. this section 78*d* extends at a certain height above the knitting tools 2, 3 transversely over the circle formed by said knitting tools, whereby it also lies in the range of action of the laying-in means 66 and of the engaging member 81. In the mean time, these have moved, together with the changing point 72, closer to the first yarn changing device 73 (FIG. 16).

Figure 18:
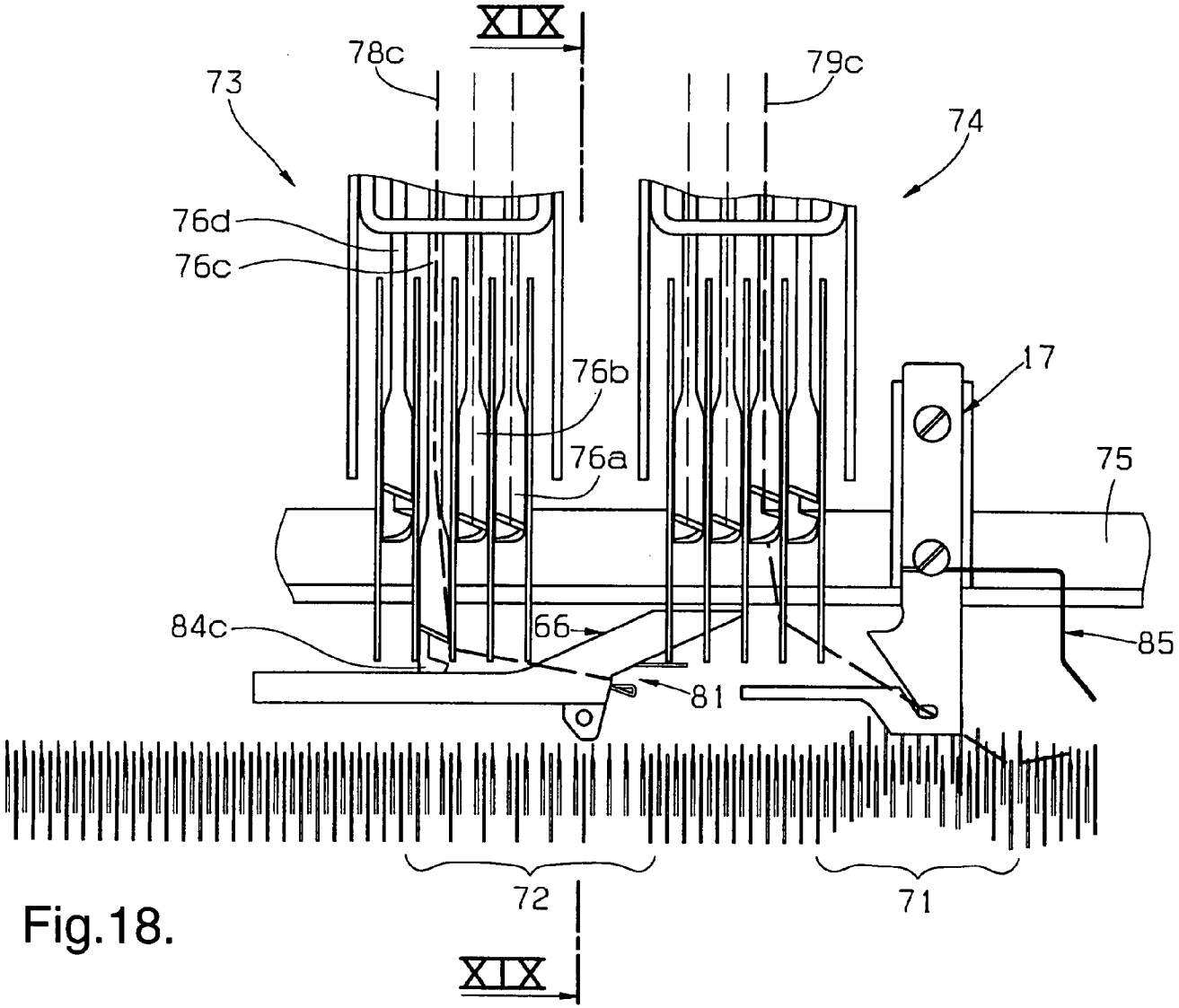
FIG. 18 shows the striping attachment according to the invention in a view according to FIG. 12, but in a further operating position.
Figure 19:
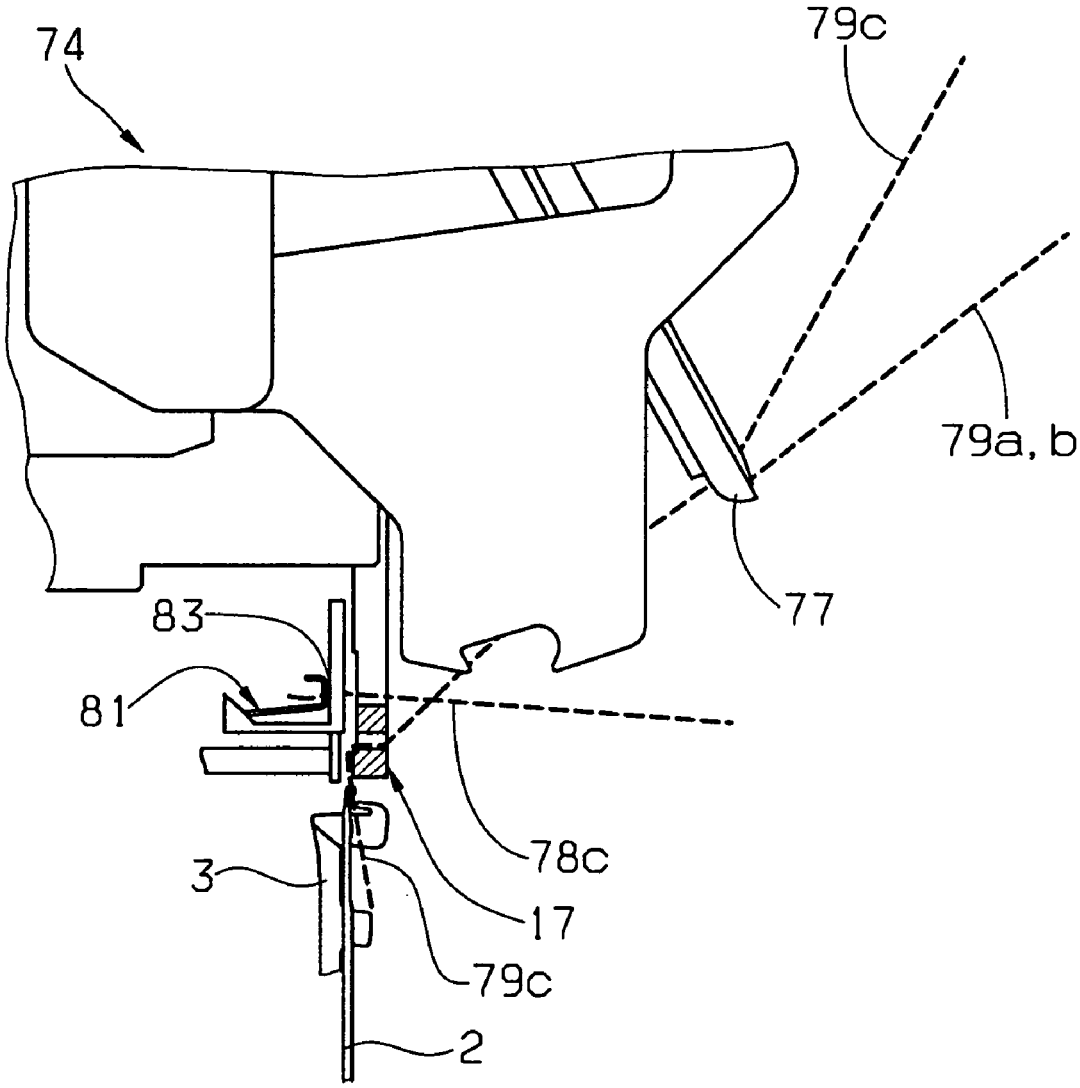
FIG. 19 shows a section along the line XIX—XIX of FIG. 18.
Figure 20:
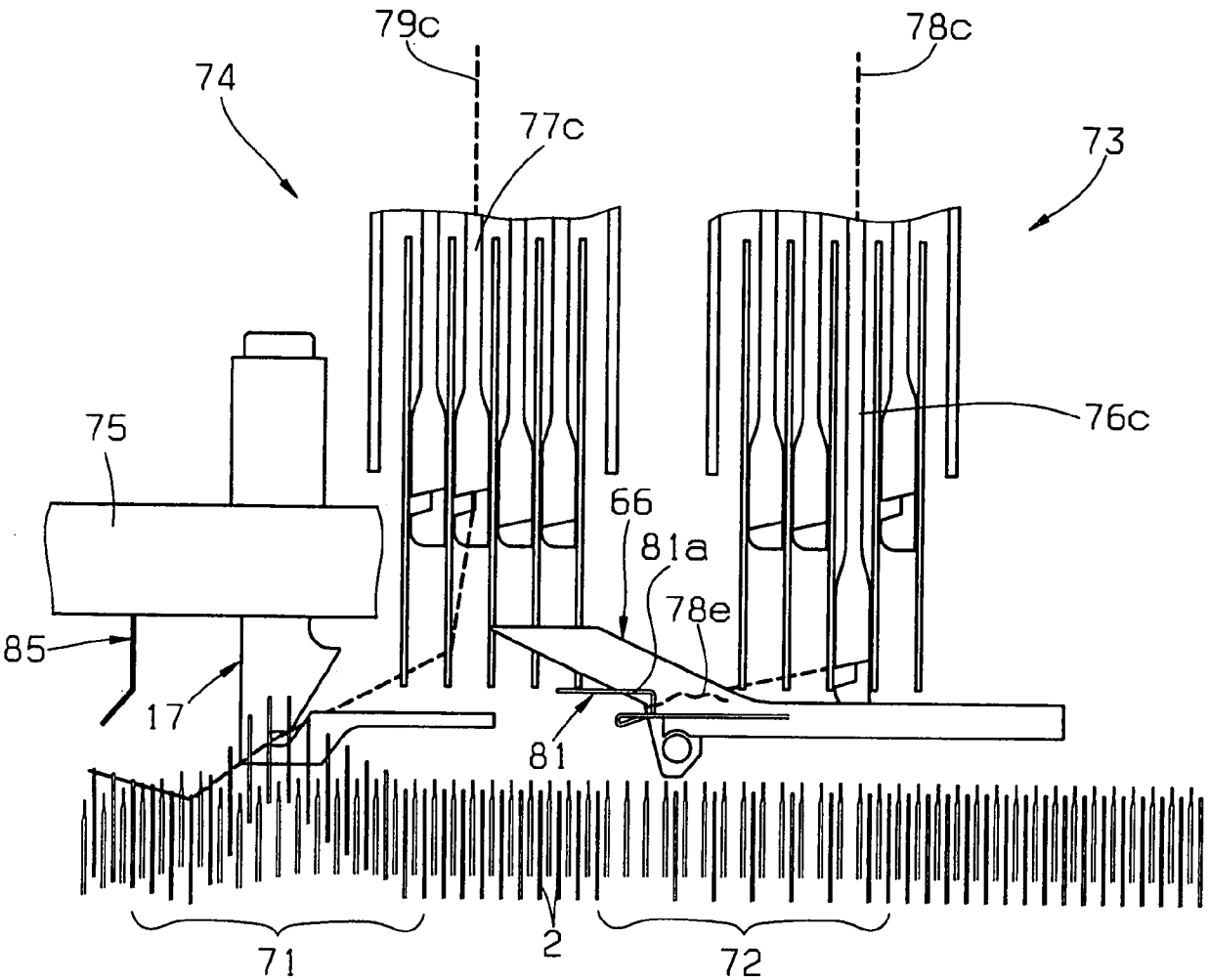
FIG. 20 shows the operating position shown in FIG. 18 of the striping attachment according to the invention, but observed radially from the centre of the machine.
Figure 22:
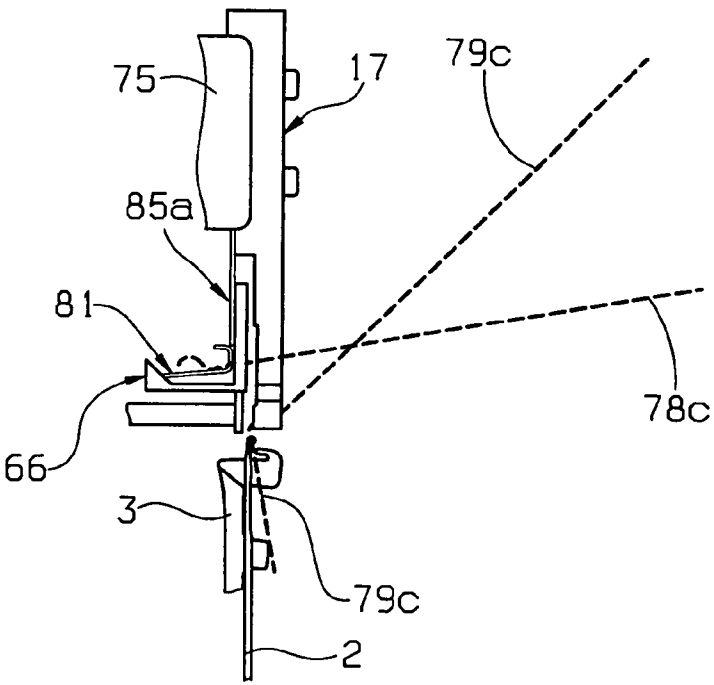
FIGS. 21 and 22 show views according to FIGS. 18 and 19 of the striping attachment according to the invention shortly before the laying of a yarn into a yarn guide.
Figure 21:
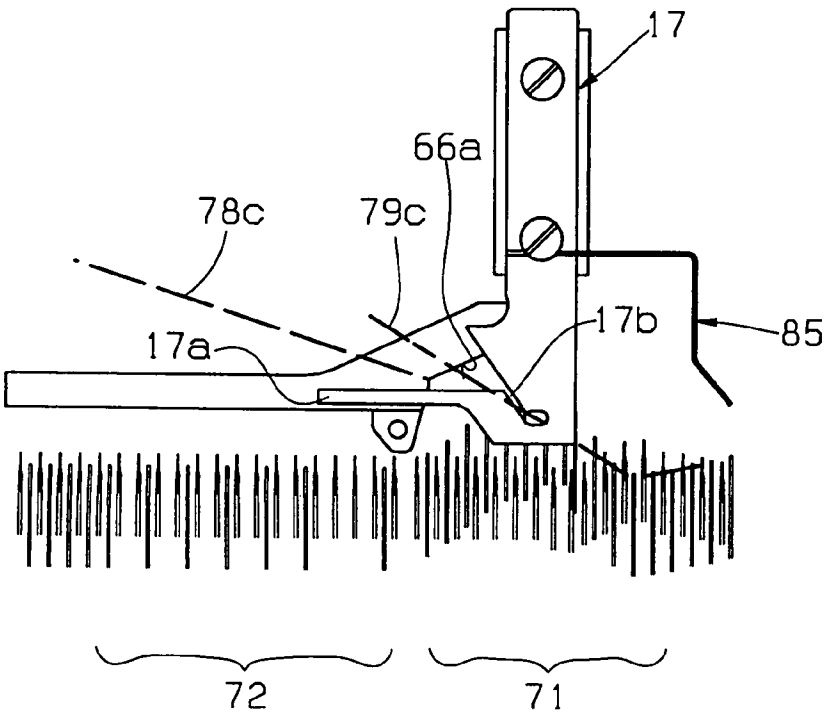
Figure 23:
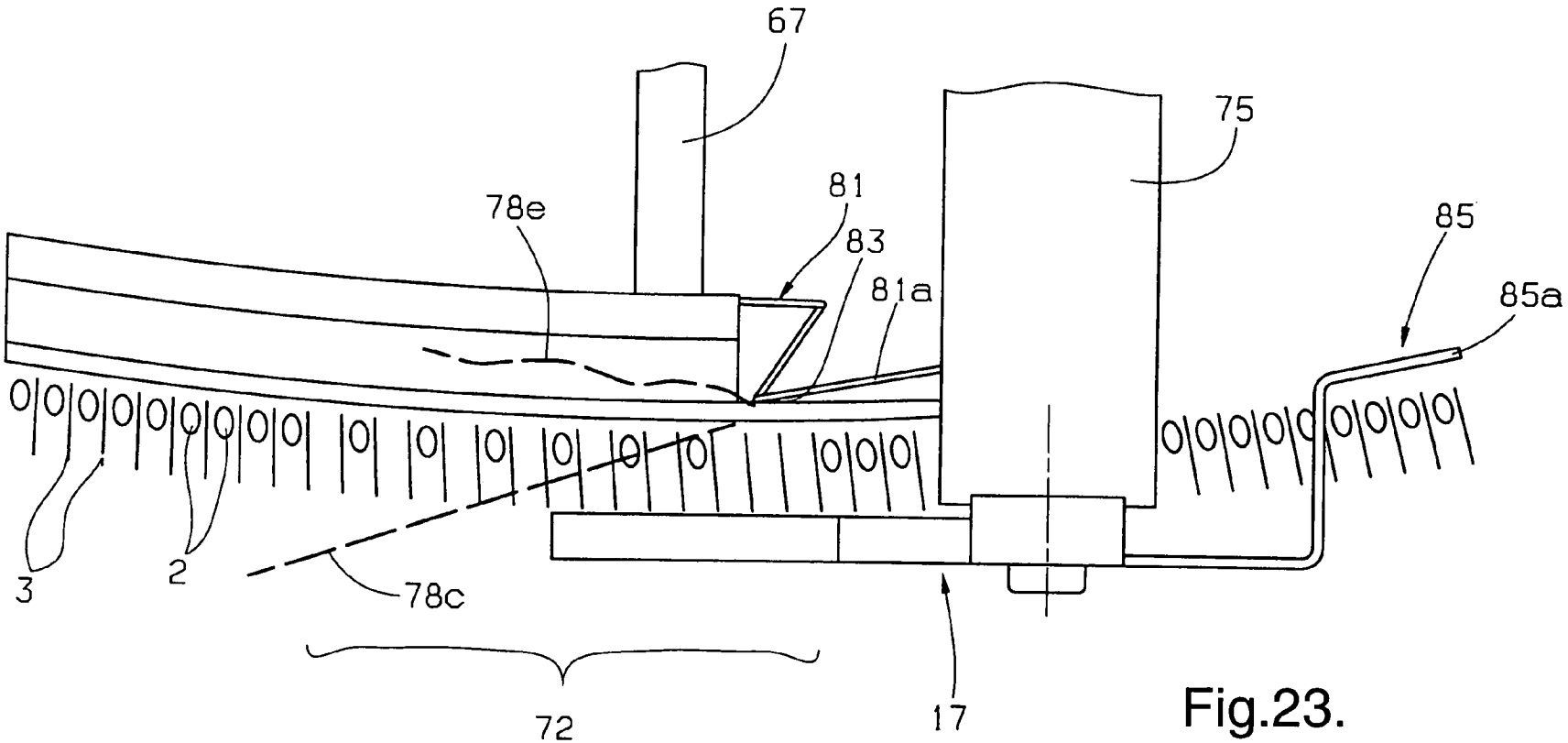
FIG. 23 shows an enlarged plan view of the portions shown in FIG. 21 of the striping attachment according to the invention.

On further movement of the engaging member 81 in the direction of the arrow v, the yarn section 78*d* lying transversely eventually is passed by the feeding-in gap 82 (FIG. 15) and then by the clamping gap 83 in which it is clamped, firmly held and, on further movement of the engaging member 81, is carried along, as FIGS. 18 to 20 show. The changing point 72, the laying-in means 66 and the engaging member 81 are situated here in a mid-position between the two yarn changing devices 73 and 74.

The switching cam 64 described based upon FIG. 2 is designed according to the invention such that, at the moment at which the yarn section 78*d* (FIG. 17) has been securely grasped by the engaging member 81, it acts upon the pusher 33 (FIG. 4) and thus also on the closer 36 and the opener 37. This action takes place precisely in the same manner as if a knitting point were also provided in the region of the first yarn changing device 73. A clamping unit 84*c* (FIG. 18) of the yarn finger 76*c* corresponding to the clamping element 44 (e.g. FIG. 6) is therefore opened for releasing a still clamped end 78*e* (FIG. 20) of the new yarn 78*c*, as FIG. 18 shows, whilst the corresponding clamping elements of the unselected yarn fingers 76*a* and 76*b* remain in the clamping position. The yarn 78*c* may therefore be freely unwound from an associated supply reel on further transport of the engaging member 81.

Figure 11:
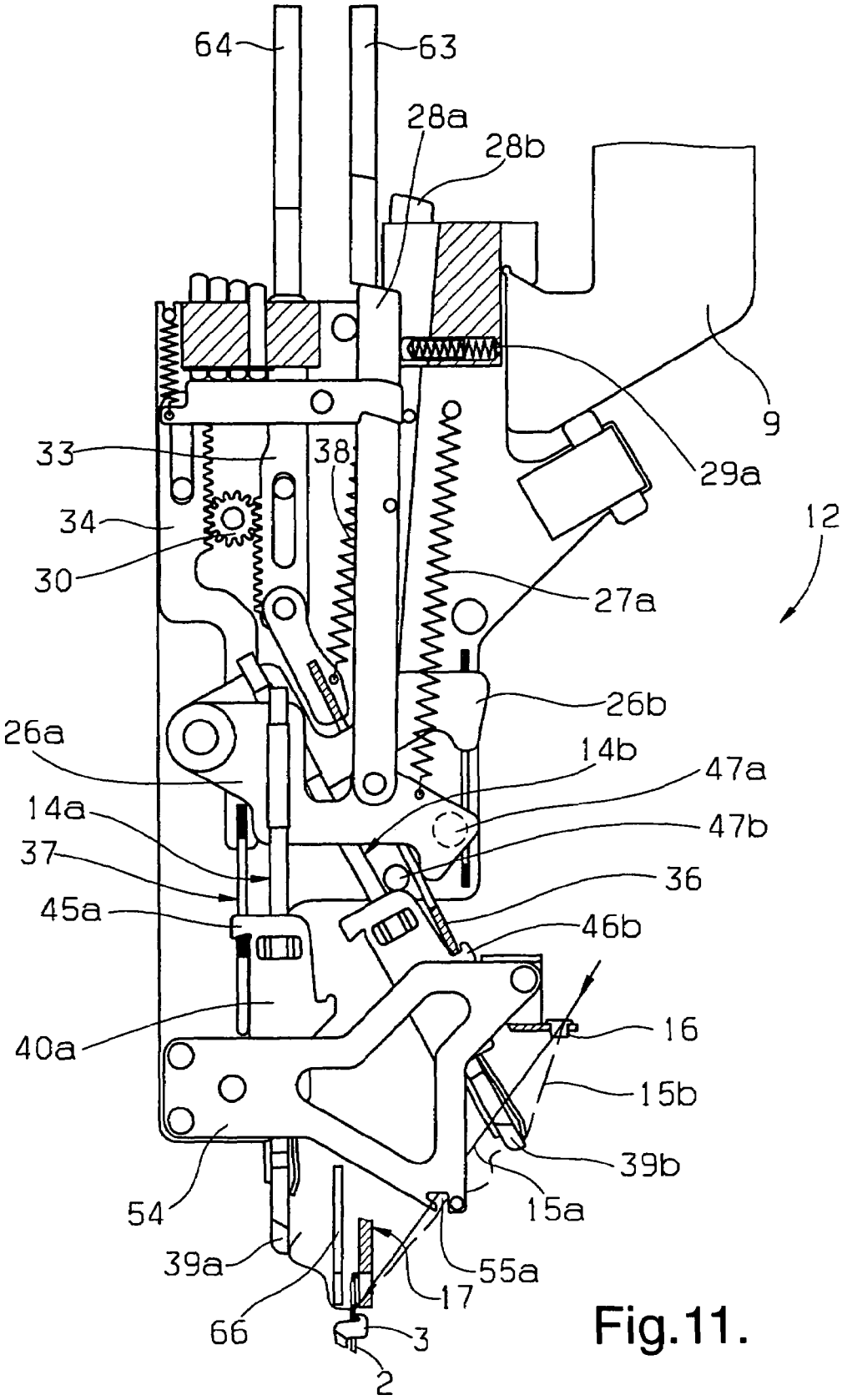

During further progress (FIGS. 21 to 23), the section of the yarn 78*c* coming from the first yarn changing device 73 becomes ever longer and is brought by the engaging member 81 ever closer to the yarn guide 17 in the region of the knitting point 71. The lower edge 66*a* of the laying-in means 66 now also becomes active in this process (FIG. 21), ensuring that the yarn 78*c* is guided above the web 17*a* of the yarn guide 17 and is then laid into its slit 17*b*. This function is substantially the same as when a yarn coming from the second yarn changing device 74 has been newly laid into the knitting tools 2, 3 (FIGS. 10, 11). The only difference consists therein that the yarn 78*c* no longer lies in the clamping element 84*c* of its yarn finger 76*c*, but is held tensioned by the engaging member 81 in the position visible in FIGS. 10 and 11, transversely to the circle of knitting tools 2.

Figure 24:
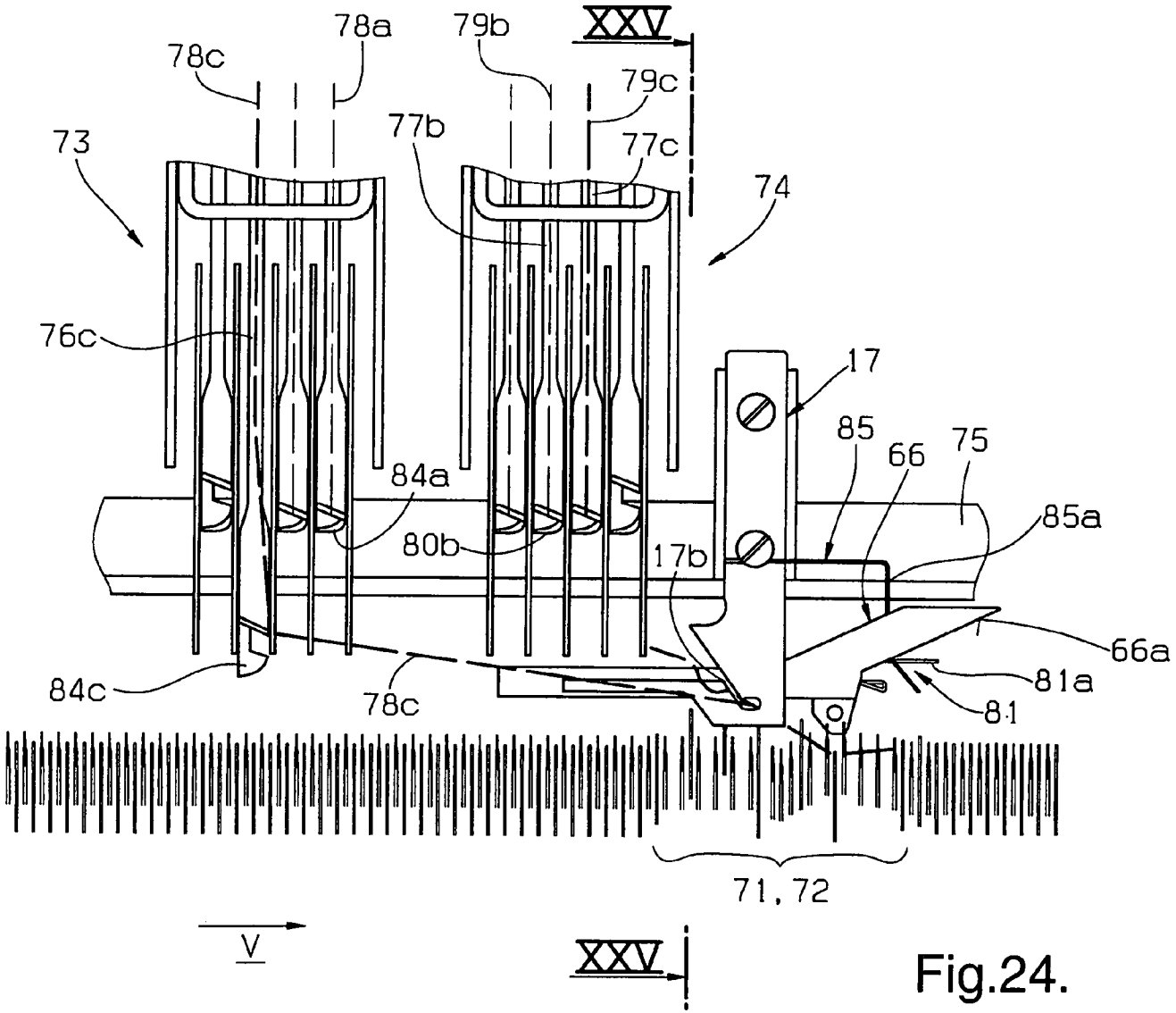
FIG. 24 shows the striping attachment according to the invention in a view according to FIG. 12, but in a further operating position.
Figure 25:
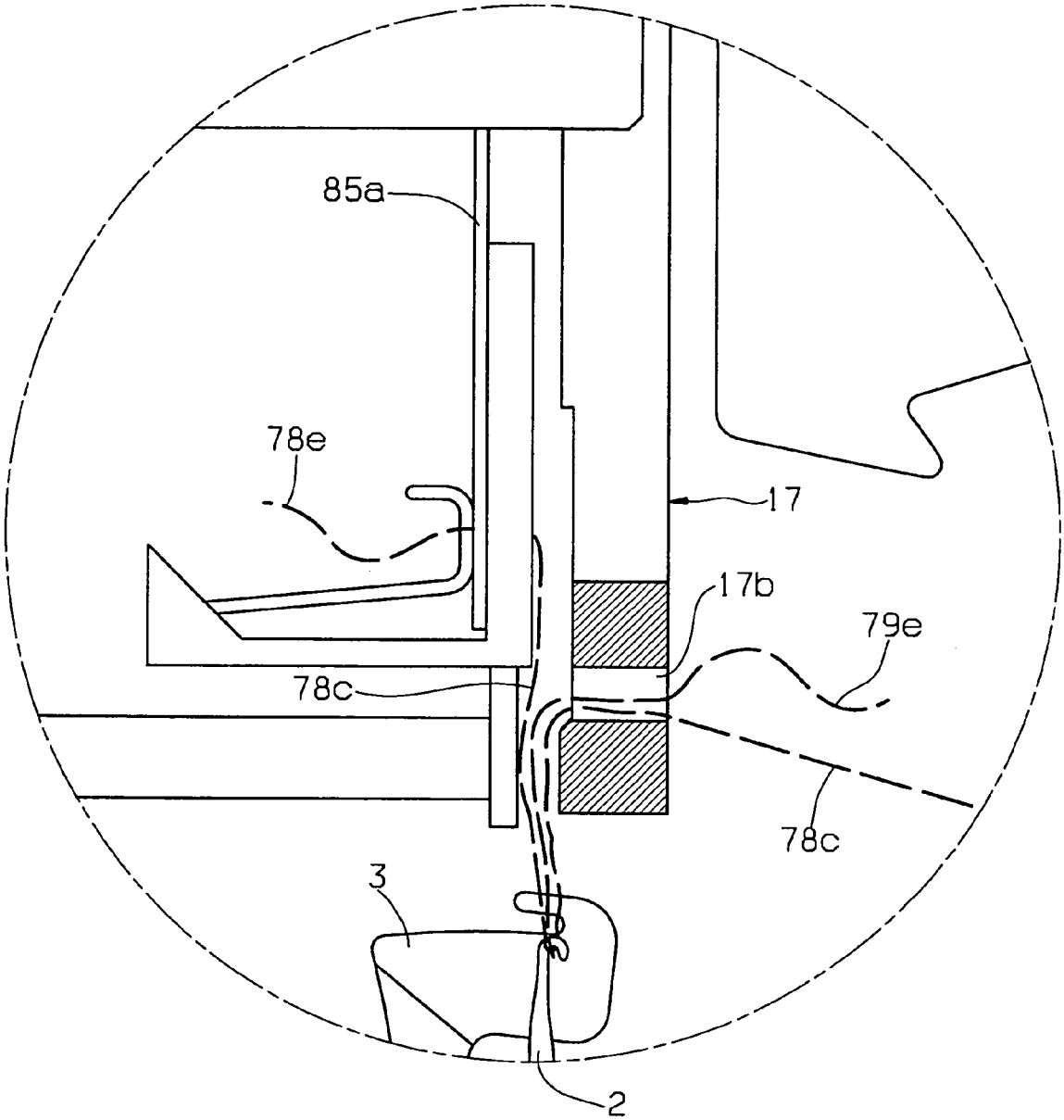
FIG. 25 shows an enlarged partial section along the line XXV—XXV of FIG. 24.
Figure 26:
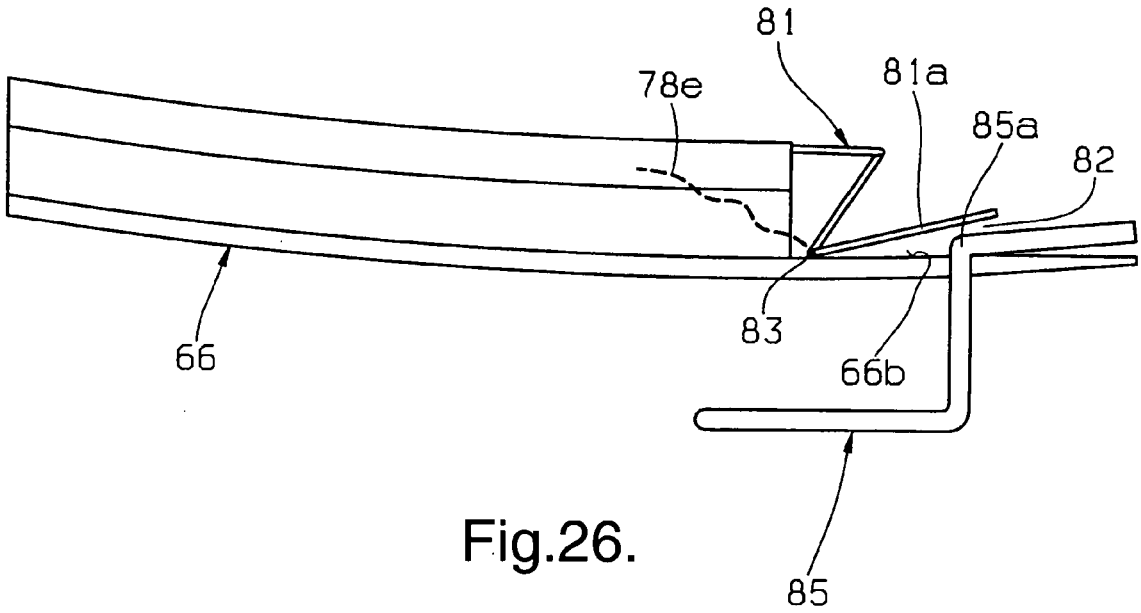
FIG. 26 shows a plan view according to FIG. 15 of the engaging member on running onto an opening organ.

Following introduction of the yarn 78*c* into the slit 17*b* of the yarn guide 17, the changing point 72 has also reached the yarn guide 17 or the knitting point 71 (FIG. 24). Therefore, in addition to the old yarn 79*c*, the new yarn 78*c* is now laid into the knitting tools 2, 3 available in the region of the changing point 72 and moving at the knitting point 71 into the yarn changing position and is preferably processed into stitches by said knitting tools.

Since in the yarn changing devices 12 (FIGS. 1 to 11) described, one of the four yarns 15 is always offered to the knitting tools 2, 3, this would have the consequence in the arrangement according to the invention that a yarn would also be fed from the second yarn changing device 74 even if a yarn (e.g. 78*c*) should actually only be delivered by the first yarn changing device 73. In order to avoid this, the yarn finger 77*d* of the yarn changing device 74 and the corresponding yarn finger 76*d* of the yarn changing device 73 lacks a yarn (FIG. 12) and therefore also a function. In the case described therefore, before the changing point 72 reaches the second yarn changing device 74, with the help of the relevant control magnet 57 of the selection apparatus 56, the yarn finger 77*d* is selected. This has the consequence that, on the one hand, when the second yarn changing device 74 is passed by the changing point 72 and the switching cam 64 (FIG. 2), the yarn finger 77*d* performs an idle motion and, on the other hand, that the yarn 79*c* carried by the yarn finger 77*c* is cut and clamped. Once the changing point 72 has passed the yarn changing device 74, an end 79*e* (FIG. 25) thereby created of the old yarn 79*c* is therefore also carried by the knitting tools 2, 3 of the changing point 72.

Once the new yarn 78*c* is securely laid into at least one and preferably into a plurality of knitting tools 2, 3 of the changing point 72, it must finally be released by the engaging member 81. Since the engaging member 81 is an elastically designed trapper, the yarn end 78*e* is in principle automatically pulled out of the clamping gap 83 (FIG. 15) on further transport of the changing point 72 in the direction of the arrow v. However in this process, as FIG. 24 illustrates, the yarn end 78*e* is relatively severely deflected in the slit 17*b* of the yarn guide 17, for which reason, in a particularly preferred embodiment of the invention, an opening organ 85 (e.g. FIGS. 21, 25) intended for automatic opening of the engaging member 81 is arranged behind the yarn guide 17 in the knitting direction. The opening organ 85 comprises, for instance, an opening rod 85*a* arranged substantially parallel to the knitting tools 2, which is arranged in the range of action of the feeding-in gap 82 of the engaging member 81. If the engaging member 81 nears the opening organ 85, then the opening rod 85*a* automatically enters the feeding-in gap 82 and, shortly thereafter, into the clamping gap 83 following it, whereby the clamping organ 81*a* is pushed in elastic manner away from the associated wall 66*b* of the laying-in means 66 and the yarn 78*c* is released. By this means, not only is the pulling of the yarn 78*c* out of the engaging member 81 facilitated, but gentle handling of the yarn 78*c* without severe tensional loading during yarn changing is also ensured. Where a plurality of knitting systems is present, an opening organ 85 of this type, which according to FIG. 27 suitably is attached to the associated yarn guide 17, is present in every knitting feed system.

Figure 27:
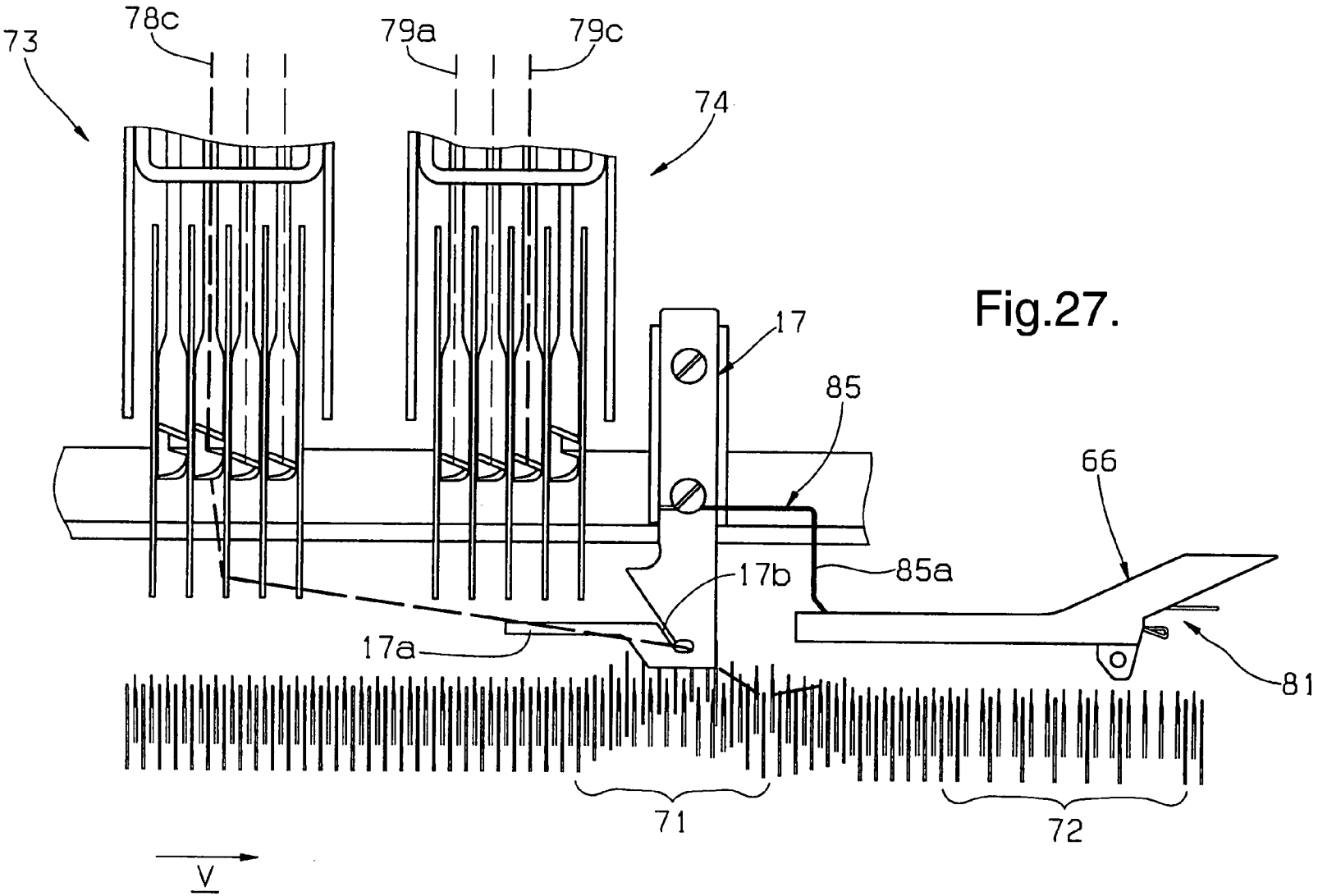
FIG. 27 shows the striping apparatus according to the invention in a view according to FIG. 12, but after completion of a yarn change.

With that, the yarn change described, from a yarn from the second yarn changing device 74 to a yarn from the first yarn changing device 73, is complete (FIG. 27).

If a change is to be made from a yarn such as 79*c* from the second yarn changing device 74 to another yarn such as 79*a* from the same yarn changing device 74, then the procedure is as described above on the basis of FIGS. 1 to 11. With its lower edge 66, the laying-in means 66 simplifies the laying-in of the new yarn 79*a* into the slit 17*b* of the yarn guide 17, whilst the engaging member 81 does not have an interfering effect during such a change-over, even if it should grasp the new yarn 79*a* in the manner described above for a short time.

On a change of yarn, such as 78*c* from the first yarn changing device 73 to another yarn, such as 78*a* from the same yarn changing device 73, the procedure is in principle also as described above on the basis of FIGS. 1 to 11. As distinct therefrom, however, the new yarn 78*a* is not laid into the knitting tools 2, 3 of the changing point 72 immediately, but is initially grasped by the engaging member 81, transported by it, according to FIGS. 12 to 27 and the above description, to the knitting point 71 and only then laid into the knitting tools 2, 3 of the changing point 72. In order to avoid that, in the process, the old yarn 78*c* is already cut and clamped before the new yarn 78*a* is laid into the first knitting tools 2, 3 of the changing point 72, which could lead to errors in the knitted fabric, the switching cam 64 (FIG. 2) and the leverage ratios of the reversing gearbox 30 to 35 (FIG. 4) are changed as follows. The switching cam 64 is provided, as in FIG. 2, with a leading cam portion 64*a* which initially pushes the pusher 33 (FIG. 11) down only a little and by just enough such that a clamping element 84*a* (FIG. 24) of the yarn finger 76*a* carrying the new yarn 78*a* is opened as soon as the yarn 78*a* lies securely in the engaging member 81. The leverage ratios are chosen such that the clamping and cutting functions are not yet carried out by the yarn finger 76*c* carrying the old yarn 78*c* at this time point. On the other hand, a following cam member 64*b* of the switching cam 64 (FIG. 2) is designed such that complete pressing down of the pusher 33 and thus a cutting and clamping procedure is only carried out in the yarn finger 76*c* carrying the old yarn 78*c* when the changing point 72 reaches the knitting point 71 and at least one knitting tool 2 has safely taken up the new yarn 78*a*. It is thereby ensured that the old yarn 78*c* may be processed with the desired yarn tension until it has at least been grasped by one of the knitting tools 2, 3 of the changing point 72 and preferably processed into a stitch. The consequently somewhat longer yarn end 78*e* of the old yarn 78*c* can be tolerated.

If, finally, a change is made from a yarn such as 78*c* from the first yarn changing device 73 to a yarn such as 79*b* from the second yarn changing device 74, the procedure is as follows. With the aid of the selection apparatus 56, initially the yarn finger 76*d* of the first yarn changing device 73 which carries no yarn and then the yarn finger 77*b* of the second yarn changing device 74 carrying the yarn 79*b* is selected. Selection of the yarn finger 76*d* has no consequences, since its clamping element is also opened if it was not already open. Due to the design of the switching cam 64 described on the basis of the previous example, the clamping element 84*c* (FIG. 24) of the yarn finger 76*c* is also still not actuated, such that the old yarn 78*c* is still laid into the knitting tools 2, 3. When the changing point 72 reaches the knitting point 71, on the one hand, by means of the switching cams 63 and 64, the yarn finger 77*b* for the new yarn 79*b* is pivoted into the working position and, on the other hand, an associated clamping element 80*b* (FIG. 24) is opened. By this means, in the manner described on the basis of FIGS. 1 to 11, the new yarn 79*b* is also offered to the knitting tools 2, 3 in the region of the changing point 72. Finally, at this time point, the cam portion 64*b* has reached the first yarn changing device 73, as described above, such that now the old yarn 78*c* is cut and clamped by means of the clamping element 84*c*.

It is possible by means of the invention, at the same knitting point 71 optionally to process the yarns 78, 79 from two adjacent yarn changing devices 73, 74. Due to the embodiment of the yarn changing devices 73, 74 described on the basis of FIGS. 1 to 11, stripe patterns may thus be made with six instead of four colours. If at least a third yarn changing device is arranged in the knitting direction before the first yarn changing device 73, in corresponding manner, nine or more yarns may be selected for striping. This selection may possibly be limited by the length of the yarn ends that are carried by the knitted fabric after cutting and clamping of the respective old yarn, in particular due to the delay in the cutting and clamping function brought about by switching cam 64 described above and also obtained when yarn changes are only undertaken between yarns of the second or a third yarn changing device 74.

If, in place of the yarn changing devices described, others are used which also feed four yarns, but may be made inactive by other means than creating an empty yarn finger (e.g. 76*d*, 77*d*), using two yarn changing devices, eight different yarns may be selected for striping. It is clear that in place of the yarn changing devices described, others with two, three or more than four yarn fingers may be used.

According to a particularly preferred embodiment of the invention, the circular knitting machine is designed such that a knitting point 71 is present on every yarn changing device 73, 74 which, by exchanging cam members, with the aid of a diverter or by other means, may optionally be brought into a run-through position or a position such that the knitting tools 2, 3 are moved, similarly to the knitting point 71, into the yarn take-up position. The circular knitting machine may then be operated, depending upon requirements, similarly to FIGS. 1 to 11 at maximum output and with few change yarns or, similarly to FIGS. 12 to 27, at reduced output but with a larger number of change yarns. If the yarn changing devices are not used, the circular knitting machine will be able to operate with the number of knitting feed systems that corresponds to the number of yarn changing devices present. Finally, for each knitting system, it could be individually decided whether none, only one, or more than one yarn changing device should be assigned to it.

A further advantage of the invention consists therein that the various members of the striping attachment comprising at least two yarn changing devices 73, 74 may also be retrofitted to a knitting machine and may be manufactured and supplied in the form of a kit for retrofitting. This applies in particular if a circular knitting machine with yarn changing devices according to FIGS. 1 to 11 is present and is only to be retrofitted for stripe patterns with more than four colours.

The invention is not restricted to the embodiment described, which can be adapted in many ways. This is particularly the case for the various parts of the yarn changing devices, in particular the closers 36 and openers 37 and the cutting and clamping elements 43 and 44. Furthermore, differently designed reversing gearboxes and yarn changing devices could be provided, whose cutting and clamping elements are actuated by other means than the reversing gearboxes described. It is also possible to mount the openers and/or closers in adjustable manner, for instance with the aid of slots, adjusting screws, eccentrics and similar, in order to adjust the time intervals at which they are to be activated. It is also understood that in place of the control magnets 57, other, in particular mechanical, pattern devices, may be provided. Furthermore, the invention is not limited to the circular knitting machine described, but may in a similar derivation be used for flat-bed knitting machines with stationary needle beds and cam carriages movable back and forth, or for circular knitting machines with stationary needle cylinders and circulating cam section rings. The knitting direction analogous to the arrow v in FIG. 12 would then be that direction in which the cam carriages or the cam section rings are moved. Furthermore, it is possible, in a similar manner to known circular knitting machines (see in particular DE 195 11 949 A1), to realise the invention in a circular rib knitting machine having both a needle cylinder and a dial, and to attach the laying-in means 66 and the engaging member 81 to at least one bearing plate inserted into a groove in the dial. It is also clear that the engaging member 81 represents a preferred embodiment, but may also be differently designed in that, for instance, it is manufactured as a separate component and independently of the laying-in means 66, and mounted or designed such that the clamping procedure does not take place automatically, but similarly to the opening by the opening organ 85, with the aid of an additional, possibly also controllable means. It is also possible at the knitting points 71 to bring always all or only selected knitting tools 2, 3 into a yarn pick-up position and to use other knitting tools than those shown, in particular, for instance, slide needles or compound needles in place of latch needles or normal holding-down sinkers or knock-down sinkers in place of the sinkers 3. Finally, it should be understood that the various features may be used in combinations other than those shown and described.

It will be understood, that each of the elements described above or two or more together, may also find a useful application in other types of construction differing from the types described above.

While the invention has been illustrated and described as embodied in a circular knitting machine and a striping attachment therefor, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Knitting machine comprising: at least one carrier (1) provided with movable knitting tools (2, 3), a cam mechanism (4) having a plurality of knitting points (71) for moving selected ones of said knitting tools (2, 3) into a yarn pick-up position, a plurality of yarn changing devices, each knitting point being provided with one of said yarn changing devices (73, 74) for selectively laying yarns (78, 79) being fed from said yarn changing devices (73, 74) into said knitting tools (2, 3) being brought into said yarn pick-up position at said knitting point (71), and means for providing at least one of said knitting points (71) with at least two mutually adjacent ones of said yarn changing devices (73, 74) for selectively laying yarns being fed from a first or at least a second yarn changing device (73, 74) into selected ones of said knitting tools (2, 3) being moved into said yarn pick-up position at said at least one knitting point (71), said second yarn changing devices preceding said first yarn changing devices in a knitting direction, said means including making inactive knitting points (71) to which are assigned said second yarn changing devices (73).

2. Knitting machine according to claim 1, wherein said first and said second yarn changing devices (73, 74) are arranged one behind the other in said knitting direction and in such a manner that said second yarn changing device (73) lies before a selected knitting point (71) in said knitting direction and that said first yarn changing device (74) lies substantially at said selected knitting point (71).

3. Knitting machine according to claim 1 and being designed as a circular knitting machine.

4. Knitting machine according to claim 3, wherein said carrier (1) is rotatably mounted about a rotation axis (18) and wherein said cam mechanism (4) and said yarn changing devices (73, 74) are arranged stationary on a periphery of said carrier (1).

5. Knitting machine according to claim 2, wherein an engaging member (81) is assigned to said yarn changing devices (73, 74), said engaging member being intended to transfer yarns fed from said second yarn changing device (73) to said knitting point (71).

6. Knitting machine according to claim 5, wherein said engaging member (81) is attached to a support ring (10) rotatably mounted about said rotation axis (18) with said carrier (1).

7. Knitting machine according to claim 5, wherein said engaging member (81) includes a trapper intended for grasping at least yarns (78) fed from second yarn changing device.

8. Knitting machine according to claim 7, wherein said trapper includes an elastic clamping organ (81*a*) automatically clamping said yarn (78).

9. Knitting machine according to claim 8, wherein an opening organ (85) for opening said trapper is arranged in a region of said knitting point (71).

10. Knitting machine according to claim 9, wherein said opening organ (85) is arranged stationary.

11. Knitting machine according to claim 1, wherein said yarn changing devices (73, 74) each have at least two yarn fingers (76, 77) being pivotable back and forth between a basic position and a working position and each being in operative connection with a selection lever, cutting and clamping elements (80*c*, 84*c*) being assigned to said yarn fingers (76, 77) and openers and closers for actuating said cutting and clamping elements (80*c*, 84*c*), and that at least one selection apparatus (56) for selecting said selection levers and at least one switching cam (64) for actuating said opener and closer are provided.

12. Knitting machine according to claim 11, wherein a reversing gearbox (30 to 35) is provided for actuating said opener and closer and wherein said switching cam (64) is provided for controlling said gearbox (30 to 35).

13. Knitting machine according to claim 5, wherein a yarn guide (17) is present at said knitting point (71) and wherein said engaging member (81) is formed on a laying-in means (66) intended for laying selected yarns (78, 79) into said yarn guide (17).

14. Knitting machine according to claim 1, and being designed as a circular rib knitting machine having a needle cylinder and a dial with grooves for accepting knitting tools (2, 3), wherein said engaging member (81) is attached to at least one bearing plate inserted into one of said grooves.

* * * * *